US006511144B2

(12) United States Patent
Otsuki

(10) Patent No.: US 6,511,144 B2
(45) Date of Patent: Jan. 28, 2003

(54) PRINTING UP TO EDGES OF PRINTING PAPER WITHOUT PLATEN SOILING

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/964,292

(22) Filed: Sep. 25, 2001

(65) Prior Publication Data

US 2002/0044165 A1 Apr. 18, 2002

(30) Foreign Application Priority Data

Sep. 27, 2000 (JP) ..... 2000-294189

(51) Int. Cl.[7] ..... B41J 2/145

(52) U.S. Cl. ..... 347/12; 347/40; 347/9; 347/104; 347/16; 347/15; 347/41

(58) Field of Search ..... 347/12, 40, 9, 347/104, 16, 15, 41

(56) References Cited

U.S. PATENT DOCUMENTS

| | | | | |
|---|---|---|---|---|
| 4,198,642 A | | 4/1980 | Gamblin | 347/41 |
| 6,050,675 A | * | 4/2000 | Bartolome | 347/41 |
| 6,227,649 B1 | * | 5/2001 | Hirabayashi et al. | 347/40 |
| 6,357,856 B1 | * | 3/2002 | Otsuki | 347/41 |

FOREIGN PATENT DOCUMENTS

| | | | | |
|---|---|---|---|---|
| JP | 2000-118058 A | * | 4/2000 | B41J/11/02 |
| JP | 2000-351205 A | * | 12/2000 | B41J/2/01 |

* cited by examiner

*Primary Examiner*—Craig Hallacher
*Assistant Examiner*—Leonard Liang
(74) *Attorney, Agent, or Firm*—Beyer Weaver & Thomas

(57) ABSTRACT

Images are printed up to the edges of printing paper while preventing ink droplets from depositing on the platen. The platen 26 of the inventive printer comprises, in order from the upstream side in the sub-scanning direction, an upstream support 26*sf*, an upstream slot 26*f*, a central support 26*c*, a downstream slot 26*r*. In this printer, the images in the upper-edge portion of printing paper are printed solely by a fourth group of nozzles Nr opposite the downstream slot 26*r*, the images in the lower-edge portion of printing paper are printed solely by a second group of nozzles Nh opposite the upstream slot 26*f*. An upper-edge transitional routine is performed for the area between the upper-edge portion the intermediate printing portion such that images are printed using all the nozzles (as in the intermediate portion) while sub-scanning is performed the system is fed in the same manner as in the upper-edge portion. In addition, the same type of feeding related to sub-scanning as that performed for the lower-edge portion is carried out to print images between the intermediate portion the lower-edge portion, a transitional routine for printing images along the lower edge is carried out using nozzle groups Nh, Ni, Nr. Performing these transitional routines allows the upper-edge routine, intermediate routine, lower-edge routine to be carried out in a smooth manner without reversing the feed direction during sub-scanning.

10 Claims, 19 Drawing Sheets

PRINTING UP TO EDGES OF PRINTING PAPER WITHOUT PLATEN SOILING

BACKGROUND OF THE INVENTION

1. Field of the Invention

The present invention relates to a technique for recording dots on the surface of a recording medium with the aid of a dot-recording head, and more particularly to a technique for printing images up to the edges of printing paper without soiling the platen.

2. Description of the Related Art

Printers in which ink is ejected from the nozzles of a print head have recently become popular as computer output devices. FIG. 19 is a side view depicting the periphery of a print head for a conventional printer. Printing paper P is supported on a platen 26*o* while facing the head 28*o*. The printing paper P is fed in the direction of arrow A by the upstream paper feed rollers 25*p* and 25*q* disposed upstream of the platen 26*o* and by the downstream paper peed rollers 25*r* and 25*s* disposed downstream of the platen 26*o*. Dots are recorded and images printed on the printing paper P when ink is ejected from the head.

SUMMARY OF THE INVENTION

When an attempt is made to print images up to the edges of printing paper with the aid of such a printer, it is necessary to arrange the printing paper such that the edges of the printing paper are disposed underneath the print head (that is, on the platen) and to cause ink droplets to be ejected from the print head. With such printing, however, the ink droplets sometimes miss the edges of the printing paper (for which the droplets have been originally intended) and end up depositing on the platen due to errors developing during the feeding of the printing paper, a shift in the impact location of the ink droplets, or the like. In such cases, the ink deposited on the platen soils the printing paper transported over the platen in the next step.

It is an object of the present invention, which was perfected in order to overcome the above-described shortcomings of the prior art, to provide a technique that allows images to be printed up to the edges of printing paper while preventing ink droplets from depositing on the platen.

Perfected in order to at least partially overcome the above-described shortcomings, the present invention envisages performing specific procedures with a dot-recording device for recording ink dots on a surface of a print medium with the aid of a dot-recording head provided with a group of dot-forming elements composed of a plurality of dot-forming elements for ejecting ink droplets. The dot-recording device comprises a main scanning unit, a head driver, a platen, a sub-scanning unit and a controller. The main scanning unit is configured to drive the dot-recording head and/or the print medium to perform main scanning. The head driver is configured to drive at least some of the dot-forming elements to form dots during the main scanning. The platen is configured to extend in a main scanning direction and to be disposed opposite the dot-forming elements at least along part of a main scan path. The platen is configured to support the print medium at a position opposite the dot-recording head. The sub-scanning unit is configured to move the print medium to perform sub-scanning across the main scanning direction in between the main scan paths. The controller configured to control the dot-recording device.

The platen comprises a first support member, a first slot, a second support member and a second slot. The first support member is configured to support the print medium. The first support member extends in the main scanning direction. The width of the first support member in a sub-scanning direction corresponds to a first sub-scanning range on a surface of the dot-recording head including a preselected first sub-group of dot-forming elements. The first slot extends in the main scanning direction. The width of the first slot in the sub-scanning direction corresponds to a second sub-scanning range on the surface of the dot-recording head including a preselected second sub-group of dot-forming elements. The second sub-group of dot-forming elements is disposed in the sub-scanning direction downstream from the first sub-group of dot-forming elements. The second support member is configured to support the print medium. The second support member extends in the main scanning direction. The width of the second support member in the sub-scanning direction corresponds to a third sub-scanning range on the surface of the dot-recording head including a preselected third sub-group of dot-forming elements. The third sub-group of dot-forming elements is disposed in the sub-scanning direction downstream from the second sub-group of dot-forming elements. The second slot extends in the main scanning direction. The width of the second slot in the sub-scanning direction corresponds to a fourth sub-scanning range on the surface of the dot-recording head including a preselected fourth sub-group of dot-forming elements. The fourth sub-group is disposed in the sub-scanning direction downstream from the third sub-group of dot-forming elements.

With this dot-recording device, printing is accomplished in the following manner. Here, the surface of the print medium is divided, in order from the front edge, into a front-edge portion containing the front edge, a front-edge transitional portion, an intermediate portion, a rear-edge transitional portion, a rear-edge portion containing the rear edge. Dots are formed in the front-edge portion in accordance with a first sub-scanning mode using the fourth sub-group of dot-forming elements without use of any of the first to third sub-groups of dot-forming elements. Then dots are formed in the front-edge transitional portion in accordance with the first sub-scanning mode using the first to fourth sub-groups of dot-forming elements. Dots are formed in the intermediate portion using the first to fourth sub-groups of dot-forming elements in accordance with a second sub-scanning mode. The maximum sub-scan feed amount in the second sub-scanning mode is greater than a maximum sub-scan feed amount in the first sub-scanning mode.

Adopting such an embodiment allows dots to be formed up to the front edge of the print medium without platen soiling. A transfer from the formation of dots in the front-edge portion using the fourth sub-group of dot-forming elements to the formation of dots in the intermediate portion using the first to fourth sub-groups of dot-forming elements can be accomplished in a smooth manner without reversing the feed direction in the course of sub-scanning.

In the formation of dots in the front-edge portion, an arrangement can be adopted in which such dots are formed when the print medium is supported on the platen the front edge of the print medium is above the second slot. Adopting such an embodiment allows dots to be formed without blank spaces along the front edge of the print medium using the forth sub-group of dot-forming elements.

The following printing routine should preferably be adopted after dots have been formed in the intermediate portion. Dots are formed in the rear-edge transitional portion using the second to fourth sub-groups of dot-forming elements without use of the first sub-group of dot-forming elements. The dot forming is performed in accordance with a third sub-scanning mode. The maximum sub-scan feed amount in the third sub-scanning mode is less than the maximum sub-scan feed amount in the second sub-scanning mode. Then dots are formed in the rear-edge portion in accordance with the third sub-scanning mode using the second sub-group of dot-forming elements without use of any of the first, third, and fourth sub-groups of dot-forming elements.

Adopting such an embodiment allows dots to be formed up to the rear edge of the print medium without platen soiling. A transfer from the formation of dots in the intermediate portion using the first to fourth sub-groups of dot-forming elements to the formation of dots in the rear-edge portion using second sub-group of dot-forming elements can be accomplished in a smooth manner without reversing the feed direction in the course of sub-scanning.

During the formation of dots in the rear-edge portion, an arrangement can be adopted in which such dots are formed when the print medium is supported on the platen the rear edge of the print medium is above the first slot. Adopting such an embodiment allows dots to be formed without blank spaces along the rear edge of the print medium using the second sub-group of dot-forming elements.

The present invention can be implemented as the following embodiments.

(1) A dot-recording device, dot-recording control device, or printing device.
(2) A dot-recording method, dot-recording control method, or printing method.
(3) A computer program for operating the device or implementing the method.
(4) A storage medium containing computer programs for operating the device or implementing the method.
(5) A data signal carried by a carrier wave designed to contain a computer program for operating the device or implementing the method.

DESCRIPTION OF THE PREFERRED EMBODIMENT

Embodiments of the present invention will now be described through embodiments in the following sequence.

A. Overview of Embodiments

B. First Embodiment
B1. Overall Structure of Device
B2. Relation Between Image data and Printing Paper
B3. Feeding for Sub-scanning During Printing C. Second Embodiment D. Modifications
D1. Modification 1
D2. Modification 2
D3. Modification 3

A. Overview of Embodiments

Figure 1:
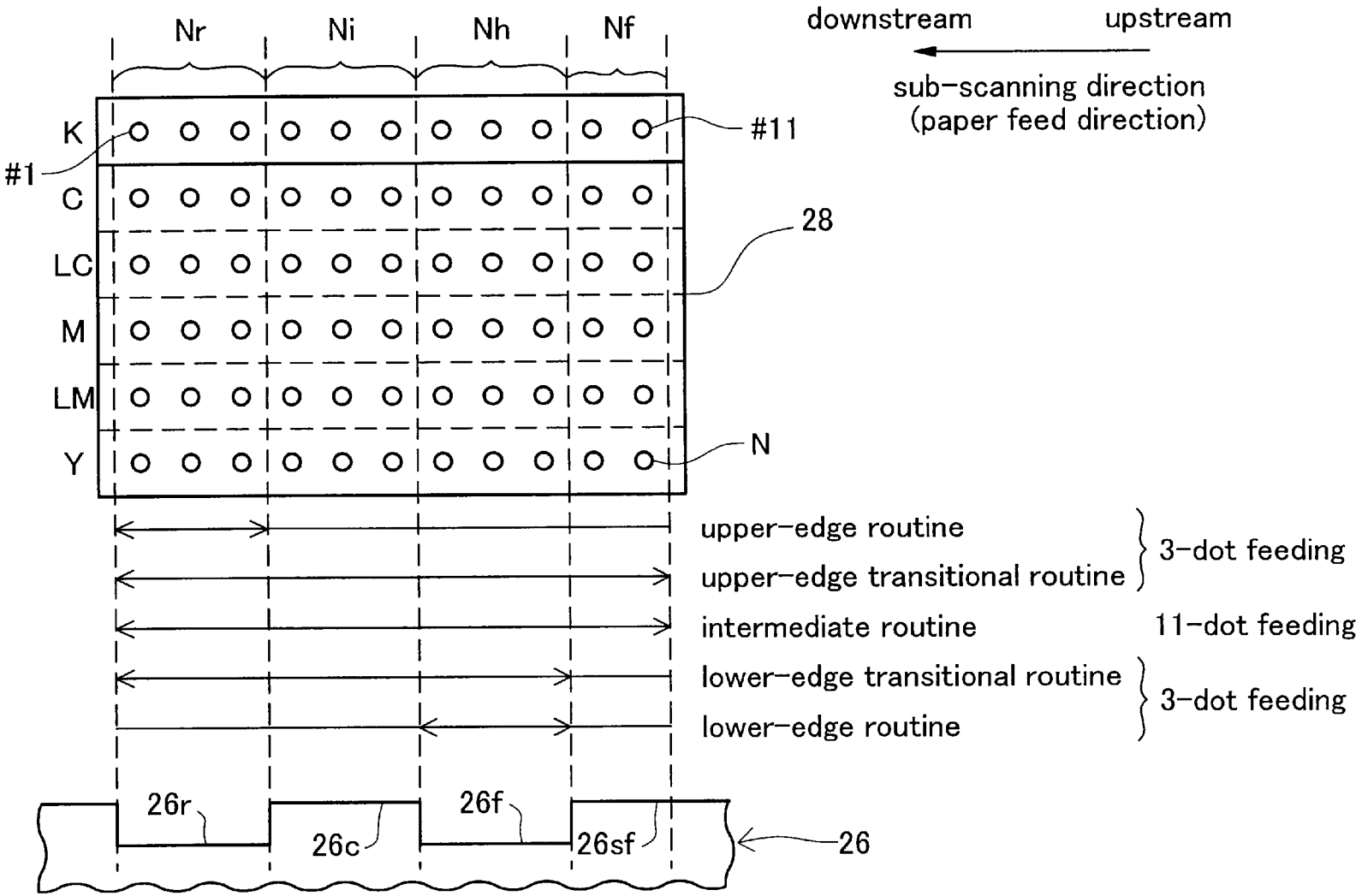
FIG. 1 is a diagram depicting the manner in which the use of nozzles belonging to the print head 28 of an ink-jet printer is varied in accordance with an embodiment of the present invention.

FIG. 1 is a diagram depicting the manner in which the use of nozzles belonging to the print head 28 of an ink-jet printer is varied in accordance with an embodiment of the present invention. In FIG. 1, the left side depicts the lower surface of the print head 28, the right side depicts, as a side view, the structure of the portions of a platen 26 corresponding to each of the nozzles N of the print head 28. The platen 26 of the printer comprises, in order from the upstream side in the sub-scanning direction, an upstream support 26*sf*, an upstream slot 26*f*, a central support 26*c*, a downstream slot 26*r*. The nozzles provided to the print head 28, which is disposed opposite the platen 26, are classified into the following groups in order from the upstream side: a first nozzle group Nf opposite the upstream support 26*sf*, a second nozzle group Nh opposite the upstream slot 26*f*, a third nozzle group Ni opposite the central portion 26*c*, a fourth nozzle group Nr opposite the downstream slot 26*r*.

In this printer, the images in the upper-edge portion of printing paper are printed solely by the fourth group of nozzles Nr opposite the downstream slot 26*r* when the upper edge of the paper is above the downstream slot 26*r* (upper-edge routine). The images in the lower-edge portion of printing paper are printed solely by the second group of nozzles Nh opposite the upstream slot 26*f* when the lower edge of the paper is above the upstream slot 26*f* (lower-edge routine). Adopting this embodiment prevents the upper surface of the platen 26 from being soiled allows images to be printed without blank spaces up to the edges of printing paper. In addition, images are printed in the intermediate portion of the printing paper by means of the entire group of nozzles (intermediate routine). Rapid printing can therefore be achieved for the intermediate portion.

The same type of feeding related to sub-scanning as that performed during the upper-edge routine is carried out between the upper-edge routine and intermediate routine; a transitional routine for printing images along the upper edge is carried out using the entire group of nozzles in the same manner as during the intermediate routine. In addition, the same type of feeding related to sub-scanning as that performed during the lower-edge routine is carried out between the intermediate routine and the lower-edge routine; a transitional routine for printing images along the lower edge is carried out using nozzle groups Nh, Ni, Nr. Specifically, the lower-edge transitional routine is carried out without the use of the nozzle group Nf. Performing these transitional routines allows the upper-edge routine, intermediate routine, and lower-edge routine to be carried out in a smooth manner without reversing the feed direction during sub-scanning or positioning the system in large feed increments.

B. First Embodiment

B1. Overall Structure of Device

Figure 2:
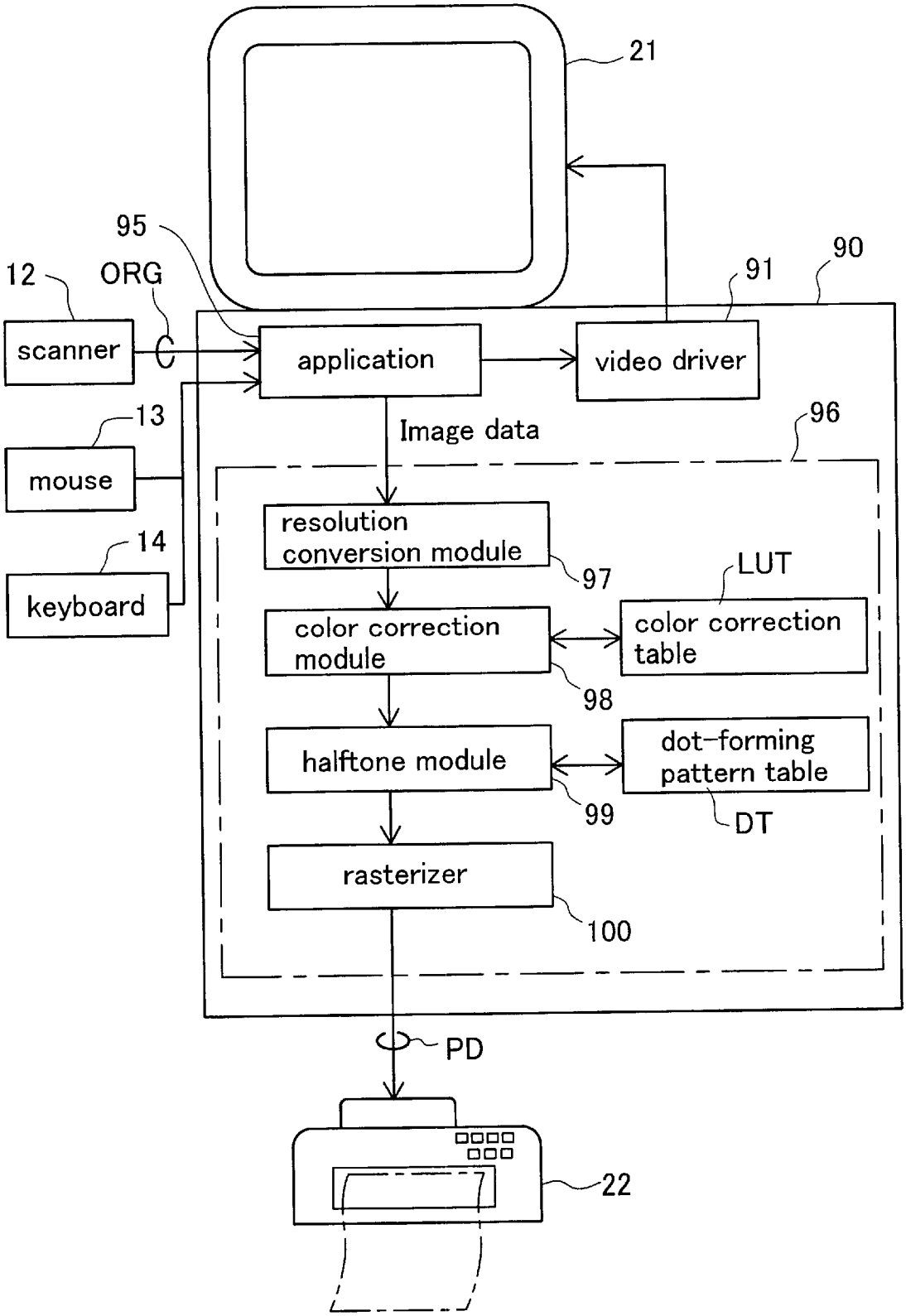
FIG. 2 is a block diagram depicting the structure of the software for the present printing device.

FIG. 2 is a block diagram depicting the structure of the software for the present printing device. In the computer 90, an application program 95 is executed within the framework of a specific operating system. The operating system contains a video driver 91 or a printer driver 96, and the application program 95 outputs the image data D to be transferred to the printer 22 by means of these drivers. The application program 95 for performing video retouching or the like allows images to be read from the scanner 12 and displayed by the CRT 21 by means of the video driver 91 while processed in a prescribed manner. The data ORG presented by the scanner 12 are in the form of primary-color image data ORG obtained by reading a color original and composed of the following three color components: red (R), green (G), and blue (B).

When the application program 95 generates a printing command according to input through the mouse 13 or keyboard, the printer driver 96 of the computer 90 receives image data from the application program 95, and the resulting data are converted to a signal that can be processed by the printer 22 (in this case, into a signal containing multiple values related to the colors cyan, magenta, light cyan, light magenta, yellow, and black). In the example shown in FIG. 2, the printer driver 96 comprises a resolution conversion module 97, a color correction module 98, a halftone module 99, and a rasterizer 100. A color correction table LUT and a dot-forming pattern table DT are also stored.

The role of the resolution conversion module 97 is to convert the resolution of the color image data handled by the application program 95 (that is, the number of pixels per unit length) into a resolution that can be handled by the printer driver 96. Because the image data converted in terms of resolution in this manner are still in the form of video information composed of three colors (RGB), the color correction module 98 converts these data into the data for each of the colors (cyan (C), magenta (M), light cyan (LC), light magenta (LM), yellow (Y), and black (K)) used by the printer 22 for individual pixels while the color correction table LUT is consulted.

The color-corrected data have a gray scale with 256 steps, for example. The halftone module 99 executes a halftone routine for expressing this gray scale in the printer 22 by forming dispersed dots. The halftone module 99 executes the halftone routine upon specifying the dot formation patterns of the corresponding ink dots in accordance with the gray scale of the image data by consulting the dot-forming pattern table DT. The image data thus processed are sorted according to the data sequence to be transferred to the printer 22 by the rasterizer 100, and are outputted as final print data PD. The print data PD contain information about the amount of feed in the sub-scanning direction and information about the condition of dot recording during each main scan. In the present embodiment, the sole role of the printer 22 is to form ink dots in accordance with the print data PD without processing the images, although it is apparent that such processing can also be carried out by the printer 22.

Figure 3:
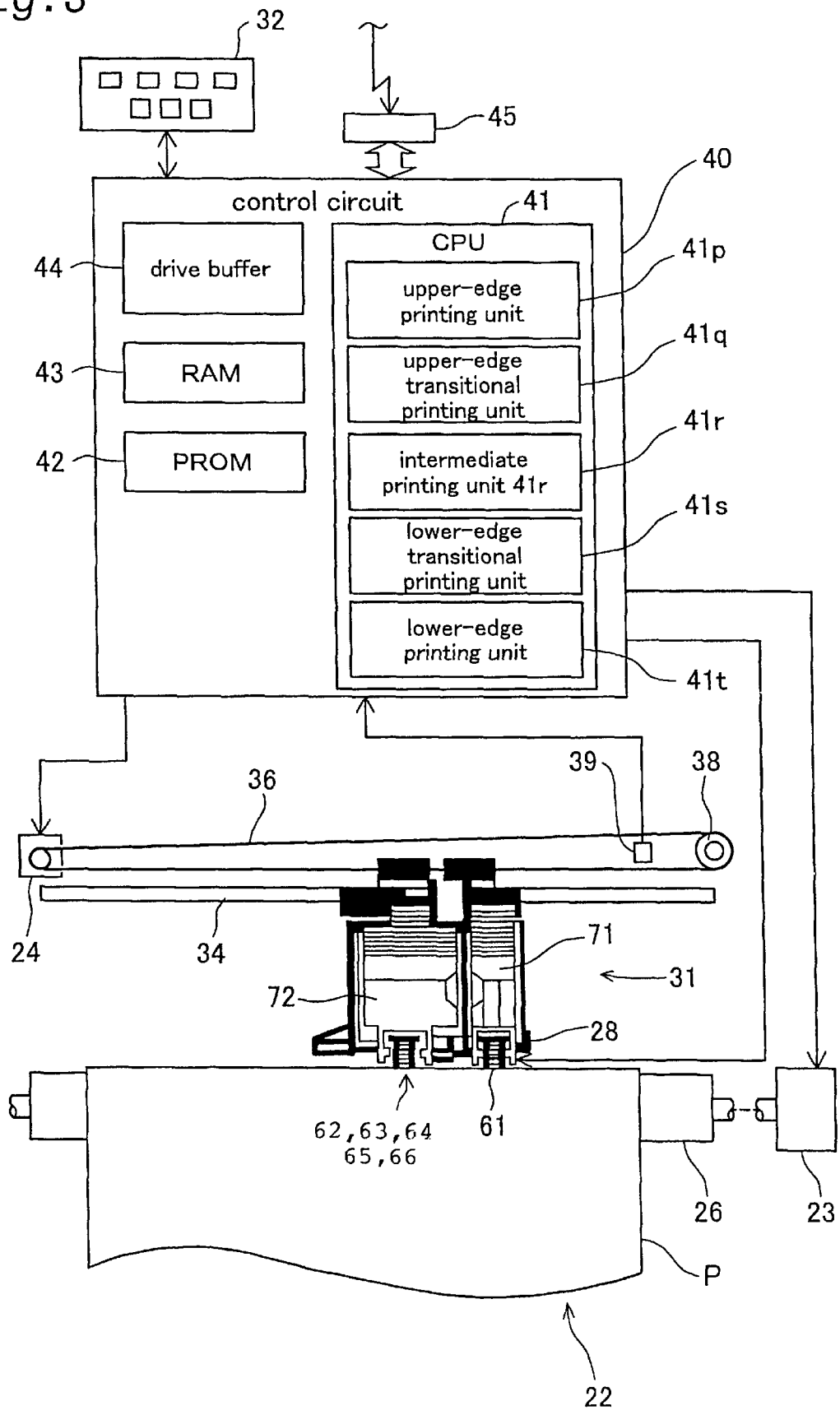
FIG. 3 is a diagram depicting the overall structure of a printer 22.

The overall structure of the printer 22 will now be described with reference to FIG. 3. As can be seen in the drawing, the printer 22 comprises a mechanism for transporting paper P with the aid of a paper feed motor 23; a mechanism for reciprocating a carriage 31 perpendicular to the direction of transport of the printing paper P; a mechanism for actuating the print head 28 mounted on the carriage 31 and ejecting the ink to form ink dots; and a control circuit 40 for exchanging signals between the paper feed motor 23, the carriage motor 24, the print head 28, and a control panel 32.

The mechanism for reciprocating the carriage 31 perpendicular to the direction of transport of the printing paper P comprises a sliding shaft 34 mounted perpendicular to the direction of transport of the printing paper P designed to slidably support the carriage 31, a pulley 38 for extending an endless drive belt 36 from the carriage motor 24, a position sensor 39 for sensing the original position of the carriage 31, and the like.

The carriage 31 can support a cartridge 71 for black ink (K) and a color-ink cartridge 72 containing inks of the following six colors: cyan (C), light cyan (LC), magenta (M), light magenta (LM), and yellow (Y). A total of six ink-ejecting heads 61 to 66 are formed in the print head 28 in the bottom portion of the carriage 31. Mounting the cartridge 71 for the black (K) ink and the cartridge 72 for the color inks on the carriage 31 allows the ink to be fed from the ink cartridges to the ejection heads 61 to 66.

Figure 4:
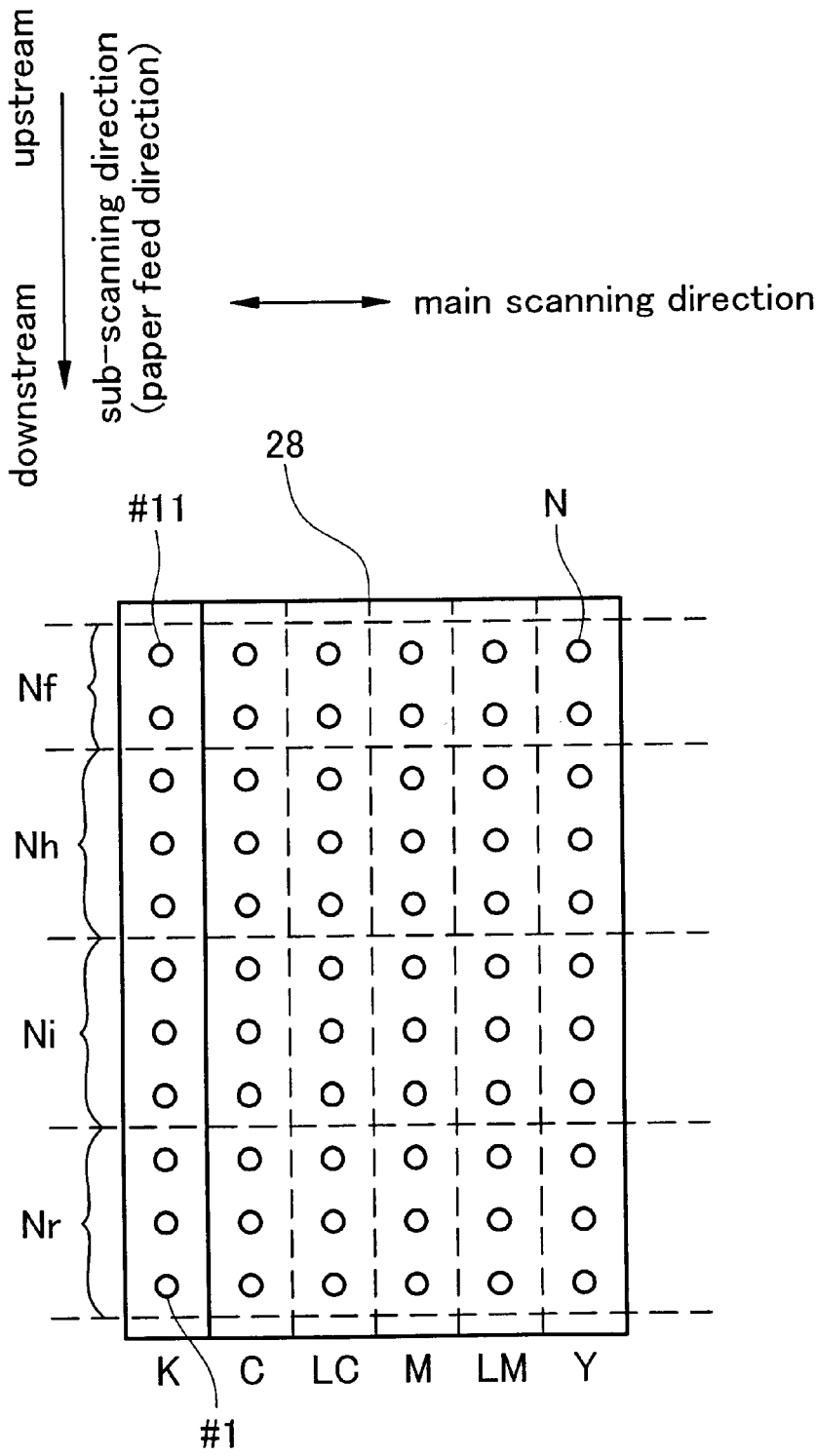
FIG. 4 is a diagram depicting an example of an arrangement adopted for the ink-jet nozzles of the print head 28.

FIG. 4 is a diagram depicting the arrangement of the ink-jet nozzles N in the print head 28. These nozzles form six nozzle arrays for ejecting the ink of each color (black (K), cyan (C), light cyan (LC), magenta (M), light magenta (LM), and yellow (Y)), and the 48 nozzles of each array form a single row at a constant pitch k. These six nozzle arrays are aligned in the main scanning direction. More specifically, the nozzle pairs for each nozzle array lie on the same main scan lines. These nozzle arrays (rows of nozzles) correspond to the dot-forming elements. Nozzle pitch is a value equal to the number of raster lines (that is, pixels) accommodated by the interval between the nozzles on the print heads in the sub-scanning direction. For example, nozzles whose intervals correspond to three interposed raster lines have a pitch k of 4. As used herein, the term "raster line" refers to a row of pixels aligned in the main scanning direction. The term "pixel" refers to a single square of an imaginary grid formed on a print medium (and occasionally beyond the edges of the print medium) in order to define the positions at which dots are recorded by the deposition of ink droplets. In FIG. 4, the nozzle arrangement is shown in enlarged form and does not reflect the actual number of nozzles or the dimensions of the head used in the embodiments.

The nozzles of each nozzle array are divided into four subgroups in order from the upstream side in the sub-scanning direction. The subgroups correspond to the subgroups of dot-forming elements. The subgroups of each nozzle array will be collectively referred to hereinbelow as "nozzle groups Nf, Nh, Ni, Nr," indicated in order from the upstream side in the sub-scanning direction. The first nozzle group Nf, which is disposed on the most upstream side, corresponds to the first sub-group of dot-forming elements, the second nozzle group Nh corresponds to the second sub-group of dot-forming elements. The third nozzle group Ni corresponds to the third sub-group of dot-forming elements, the fourth nozzle group Nr corresponds to the fourth sub-group of dot-forming elements. Here, the subgroups of dot-forming elements of each nozzle array are collectively treated as nozzle groups NF, NH, Ni, Nr. These nozzle groups are selected to correspond to the slots, supports, other structural components of the platen 26, which is disposed facing the print head 28 during main scanning. The correspondence between the nozzle groups the slots, supports, other structural components of the platen 26 will be described below.

Figure 5:
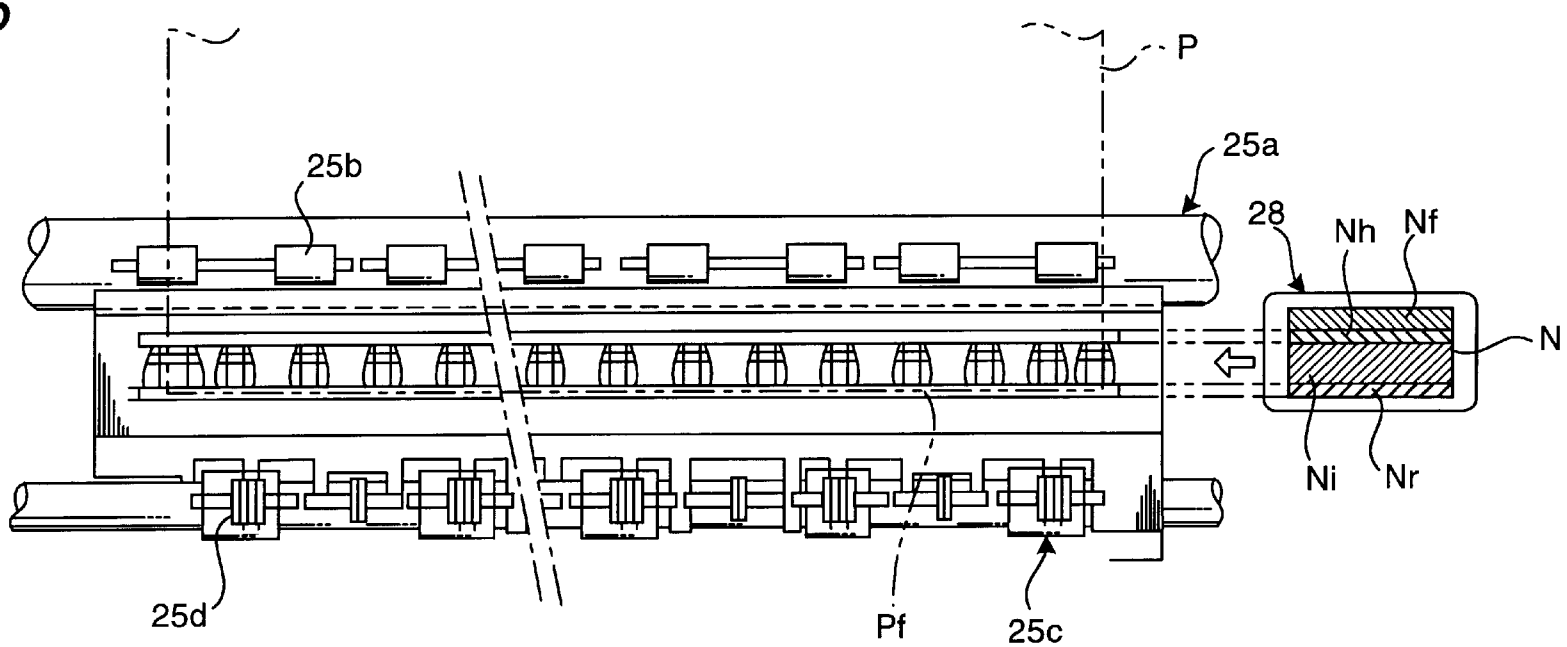
FIG. 5 is a plan view depicting the periphery of a platen 26.

FIG. 5 is a plan view depicting the periphery of the platen 26. The width of the platen 26 in the sub-scanning direction is greater than the maximum width of the printing paper P that can be accommodated by the printer 22. Upstream paper feed rollers 25*a* and 25*b* are provided upstream of the platen 26. Whereas the upstream paper feed roller 25*a* is a single drive roller, the upstream paper feed roller 25*b* comprises a plurality of freely rotating small rollers. Downstream paper feed rollers 25*c* and 25*d* are also provided downstream of the platen. The downstream paper feed roller 25*c* comprises a plurality of rollers on a drive shaft, and the downstream paper feed roller 25*d* comprises a plurality of freely rotating small rollers. The downstream paper feed roller 25*d* has radial teeth (portions between slots) in the external peripheral surface thereof and appears to be shaped as a gear when viewed in the direction of the axis of rotation. The downstream paper feed roller 25*d* is commonly referred to as a milled roller and is designed to press the printing paper P against the platen 26. The downstream paper feed roller 25*c* and upstream paper feed roller 25*a* rotate synchronously at the same peripheral speed.

The print head 28 moves back and forth in the main scanning direction over the platen 26 sandwiched between the upstream paper feed rollers 25*a* and 25*b* and the downstream paper feed rollers 25*c* and 25*d*. The printing paper P is held by the upstream paper feed rollers 25*a* and 25*b* and the downstream paper feed rollers 25*c* and 25*d*, and an intermediate portion thereof is supported by the upper surface of the platen 26 while disposed opposite the rows of nozzles in the print head 28. The paper is fed in the sub-scanning direction by the upstream paper feed rollers 25*a* and 25*b* and the downstream paper feed rollers 25*c* and 25*d*, and images are sequentially recorded by the ink ejected from the nozzles of the print head 28.

The platen 26 is provided with an upstream slot 26*f* and a downstream slot 26*r*, which are located on the upstream and downstream sides, respectively, in the sub-scanning direction. The width of the upstream slot 26*f* or downstream slot 26*r* in the main scanning direction is greater than the maximum width of the printing paper P that can be accommodated by the printer 22. In addition, absorbent members 27*f* and 27*r* for accepting and absorbing ink droplets Ip are disposed in the bottom portions of the upstream slot 26*f* and downstream slot 26*r*, respectively. The portion of the platen 26 disposed upstream of the upstream slot 26*f* is referred to as "an upstream support 26*sf*." The portion between the upstream slot 26*f* downstream slot 26*r* of the platen 26 is referred to as "a central support 26*c*." The portion of the platen downstream of the downstream slot 26*r* is referred to as "a downstream support 26*sr*." The upstream slot 26*f* corresponds to the first slot, the downstream slot 26*r* corresponds to the second slot. The upstream support 26*sf* corresponds to the first support member, the central support 26*c* corresponds to the second support member.

A description will now be given in order from the upstream side in the sub-scanning direction. First, the upstream support 26*sf* is provided such that it extends in the main scanning direction. The width of the upstream support 26*sf* in the sub-scanning direction corresponding to a first sub-scanning range on the surface of the dot-recording head including the first nozzle group Nf, which belongs to the nozzles of the print head 28 is disposed on the most upstream side. The upstream support 26*sf* is provided with a flat upper surface. The upstream slot 26*f* is then provided such that it extends in 10 the main scanning direction. The width of the upstream slot 26*f* in the sub-scanning direction corresponding to a second sub-scanning range on the surface of the dot-recording head including the second nozzle group Nh, which is disposed downstream of the first nozzle group Nf. The central support 26*c* is provided such that it extends in the main scanning direction. The width of the central support 26*c* in the sub-scanning direction corresponding to a third sub-scanning range on the surface of the dot-recording head including the third nozzle group Ni, which is disposed downstream of the second nozzle group Nh. The downstream slot 26*r* is then provided such that it extends in the main scanning direction. The width of the downstream slot 26*r* in the sub-scanning direction corresponding to a fourth sub-scanning range on the surface of the dot-recording head including the fourth nozzle group Nr, which is disposed downstream of the third nozzle group Ni. Finally, the downstream support 26*sr* is provided such that it extends in the main scanning direction at a position downstream in the sub-scanning direction from those nozzles of the print head 28 that are disposed at the downstream edge in the sub-scanning direction. In the print head 28 depicted in FIG. 5, the nozzle groups Nf, Nh, Ni, Nr are hatched with oblique lines at mutually different inclines intervals.

The inner structure of the control circuit 40 (see FIG. 3) belonging to the printer 22 will now be described. The control circuit 40 contains the following units in addition to CPU 41, PROM 42, and RAM 43: a PC interface 45 for exchanging data with the computer 90, a drive buffer 44 for outputting the ON and OFF signals of the ink jet to the ink-ejecting heads 61–66, and the like. These elements and circuits are connected together by a bus. The control circuit 40 receives the dot data processed by the computer 90, temporarily stores them in the RAM 43, and outputs the results to the drive buffer 44 according to specific timing.

In the printer 22 thus configured, the carriage 31 is reciprocated by the carriage motor 24 while paper P is transported by the paper feed motor 23, the piezoelement of each of the nozzle units belonging to the print head 28 is actuated at the same time, ink droplets Ip of each color are ejected, and ink dots are formed to produce multicolored images on the paper P.

In the first image printing mode that is described below, the areas near the top and lower edges of printing paper are printed differently from the intermediate area of the printing paper because the upper edge Pf of the printing paper P is printed over the downstream slot 26*r*, and the lower edge Pr is printed over the upstream slot 26*f*. In the present specification, the routine whereby images are printed in the intermediate area of printing paper will be referred to as an "intermediate routine," the routine whereby images are printed in the area near the upper edge of printing paper will be referred to as a "upper-edge routine," and the routine whereby images are printed in the area near the lower edge of printing paper will be referred to as a "lower-edge routine." The printing routine performed between the upper-edge routine and intermediate routine is referred to as "an upper-edge transitional routine," the printing routine performed between the intermediate routines and lower-edge routine is referred to as "a lower-edge transitional routine."

The width of the upstream slot 26*f* and downstream slot 26*r* in the sub-scanning direction can be expressed as follows.

$$W=p\times n+\alpha$$

In the formula, p is a single feed increment in the sub-scanning direction during a top- or lower-edge routine, n is the number of feed increments in the sub-scanning direction during a top- or lower-edge routine, and $\alpha$ is an estimated feed error in the sub-scanning direction during a top- or lower-edge routine. The $\alpha$-value of the lower-edge routine above the upstream slot 26*f* should preferably be set to a level above that of the $\alpha$-value for a upper-edge routine above the downstream slot 26*r*. Specifying the slot width of the platen according to this formula makes it possible to provide the slots with a width sufficient to adequately receive the ink droplets ejected from the nozzles during a top- or lower-edge routine.

B2. Relation Between Image data and Printing Paper

Figure 6:
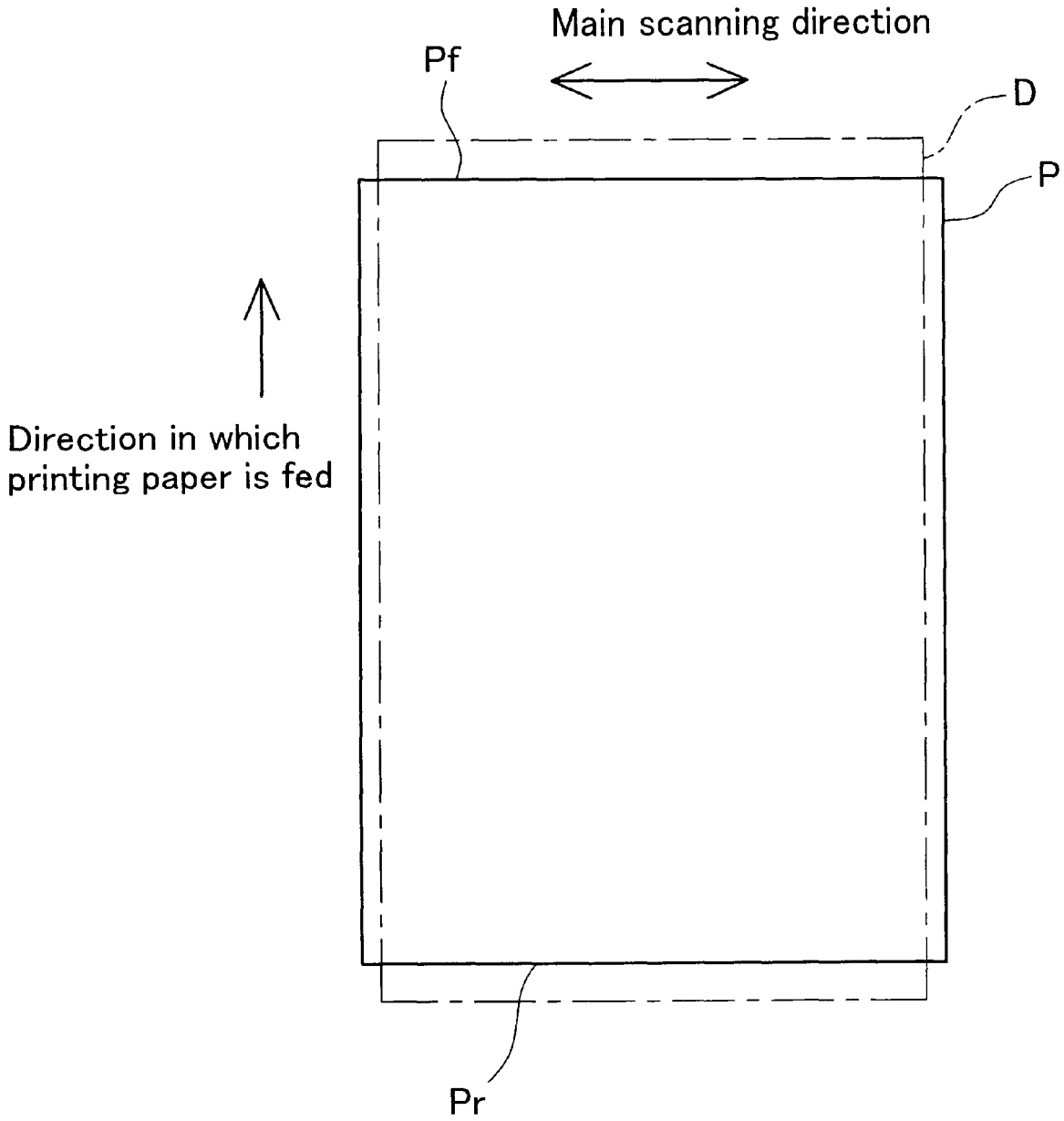
FIG. 6 is a plan view depicting the relation between image data D printing paper P.

FIG. 6 is a plan view depicting the relation between image data D and printing paper P. The first embodiment is such that image data D are provided up to the area outside the printing paper P beyond the upper edge Pf of the printing paper P. For the same reasons, the area facing the lower edge is also treated such that image data D are provided up to the area outside the printing paper P beyond the lower edge Pr of the printing paper P. The first embodiment is therefore such that the relation between the image data D and the size of the printing paper P, on the one hand, and the image data D and the arrangement of the printing paper P during printing, on the other hand, assumes the configuration shown in FIG. 6.

In the present specification, the terms "upper edge (portion)" and "lower edge (portion)" are used to designate the edges of the printing paper P corresponding to the top and bottom of the image data recorded on the printing paper P, and the terms "front edge (portion)" and "rear edge (portion)" are used to designate the edges of the printing paper P corresponding to the direction in which the printing paper P is advanced during sub-scanning in the printer 22. In the present specification, the term "upper edge (portion)" corresponds to the front edge (portion) of the printing paper P, and the term "lower edge (portion)" corresponds to the rear edge (portion).

Figure 7:
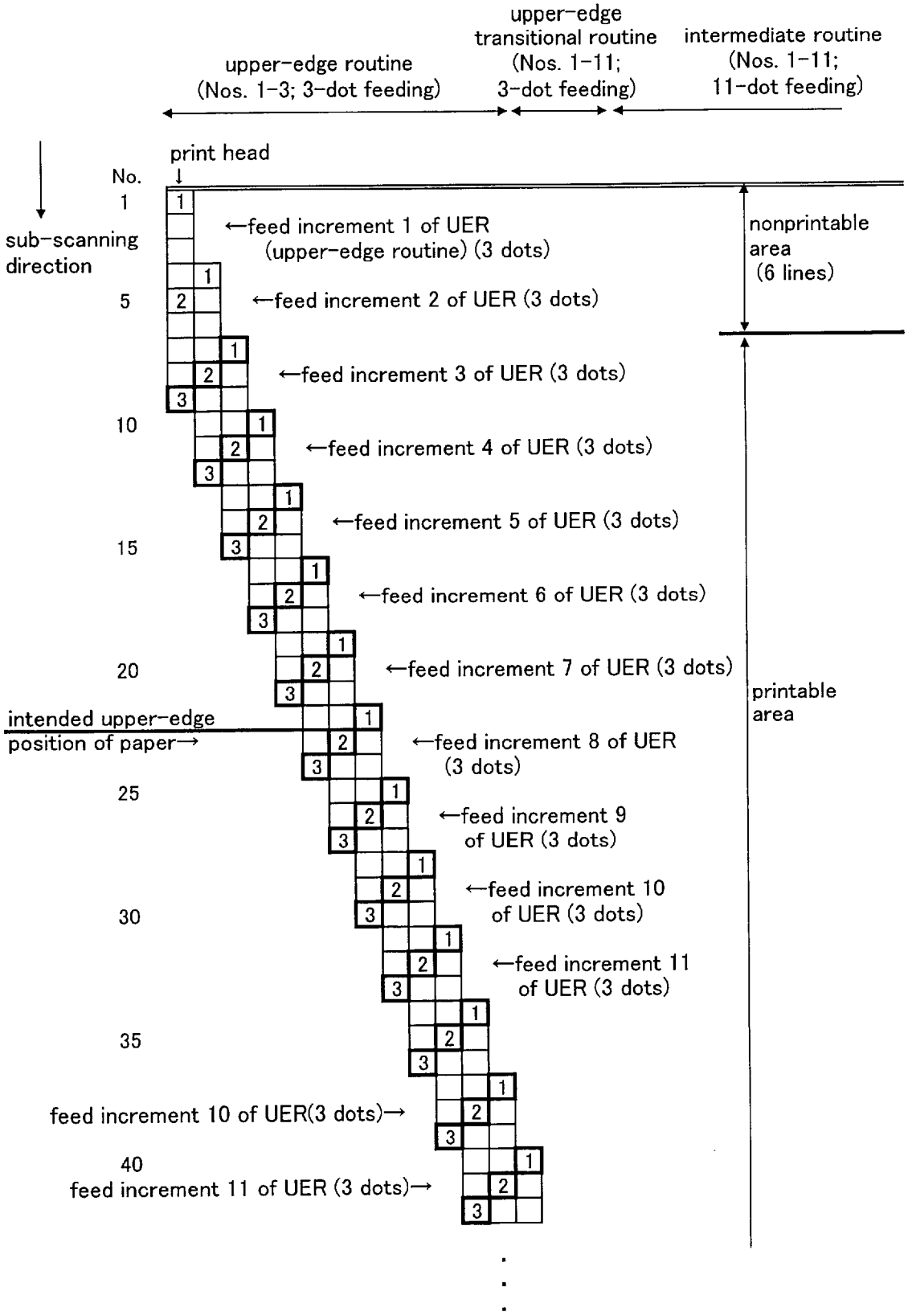
FIG. 7 is a diagram depicting the manner in which raster lines are recorded by particular nozzles in the area near the upper edge (tip) of printing paper.

B3. Feeding for Sub-scanning During Printing (1) Upper-edge Routine of First Embodiment FIG. 7 is a diagram depicting the manner in which raster lines are recorded by particular nozzles in an area near the upper edge (tip) of printing paper. For the sake of simplicity, the description will be limited to a single row of nozzles. It is assumed that a single row contains eleven nozzles with the nozzle pitch for 3 raster lines.

The three nozzles disposed on the downstream side in the sub-scanning direction are the only nozzles used for the upper-edge routine, however. In FIG. 7, only the three nozzles participating in the printing operation are shown, with the rest of the nozzles omitted from the drawing. In FIG. 7, a single vertical column of squares represents the print head 28. The numerals 1–3 in each square indicate nozzle numbers. In the present specification, "No." is attached to these numbers to indicate each nozzle. In FIG. 7, the print head 28, which is transported over time in relative fashion in the sub-scanning direction, is shown moving in sequence from left to right. The nozzles within bold boxes are used for recording dots on raster lines.

Nozzle Nos. 1–3 alone are used to perform the upper-edge routine, as shown in FIG. 7. As used herein, the term "nozzle Nos. 1 2 are used" refers to the fact that nozzle Nos. 1 2 can be used as needed. At least some of the nozzles belonging to the group of nozzles composed of nozzle Nos. 1 2 should therefore be used, some of the other nozzles may sometimes be left unused, depending on the image data involved in the printing process or on the combinations of nozzles passing over the raster lines. In addition, the term "nozzle Nos. 3 4 are left unused" during a routine refers to the fact that neither of nozzle Nos. 3 4 is used even once during this routine.

During the upper-edge routine, 3-dot feeding is repeated 12 times during sub-scanning. This 3-dot feeding during sub-scanning corresponds to the first sub-scanning mode. The term "dot," which is used as a unit of feeding during sub-scanning, refers to the single-dot pitch that corresponds to the printing resolution in the sub-scanning direction is equal to the raster line pitch. The area (see FIG. 7) on the printing paper P over which images are recorded during the 12 cycles of 3-dot feeding corresponds to the upper-edge portion.

With the exception of some raster lines, each raster line is recorded by a single nozzle during such feeding in the course of sub-scanning. For example, the seventh raster line from the top in FIG. 7 is recorded by nozzle No. 1. The eight raster line from the top is recorded by nozzle No. 2.

As is also shown in FIG. 7, no nozzles pass over the second, third, or sixth raster line (as counted from the top) when the system is scanned in the main scanning direction during printing. It is therefore impossible for the nozzles to form dots in the pixels of these raster lines. Consequently, it is assumed with respect to the first image printing mode that the raster lines up to the sixth raster line from the top cannot be used for recording images. Specifically, it is assumed with reference to the first image printing mode that only the seventh and greater raster lines, as counted from the upstream edge in the sub-scanning direction, can be considered as the raster lines on which the nozzles of the print head 28 can form dots in order to record images. The raster line area in which images can be recorded in this manner is referred to as a printable area. In addition, the raster line area in which image cannot be recorded is referred to as a nonprintable area. In FIG. 7, the numbers attached in order from top to the raster lines in which dots can be recorded by the nozzles of the print head 28 are indicated on the left side of the drawing. The same applies hereinbelow to the drawings illustrating the recording of dots during the upper-edge routine.

Figure 8:
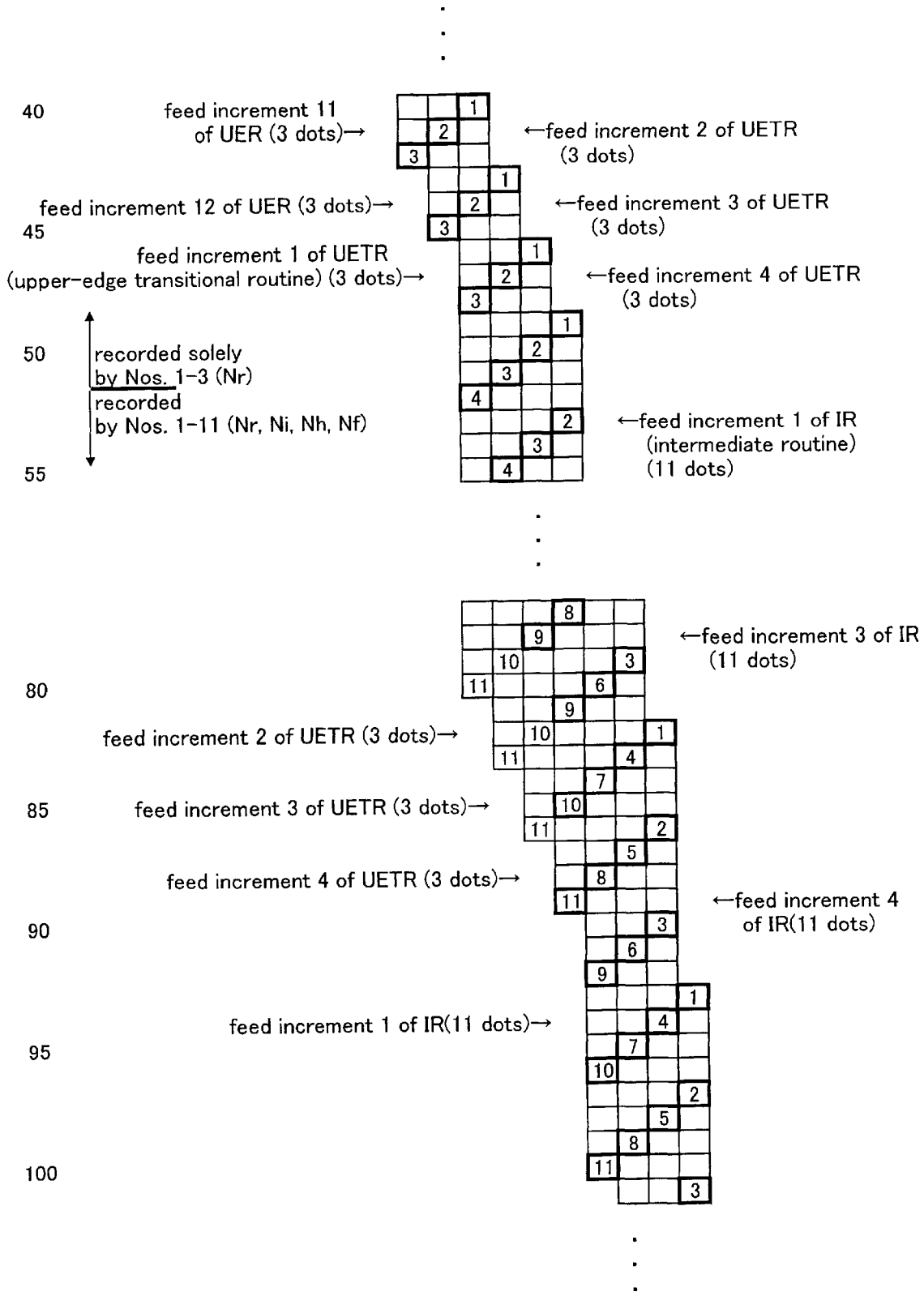
FIG. 8 is a diagram depicting the manner in which raster lines are recorded by particular nozzles during the upper-edge routine, upper-edge transitional routine, intermediate routine.

FIG. 8 is a diagram depicting the manner in which raster lines are recorded by particular nozzles during the upper-edge routine, upper-edge transitional routine, intermediate routine. The printer 22 performs the upper-edge transitional routine with the aid of nozzle Nos. 1–11 after performing the upper-edge routine. During the upper-edge transitional routine, 3-dot incremental feeding is repeated four times in the course of sub-scanning in the same manner as during the upper-edge routine. The area (see FIG. 8) on the printing paper P over which images are recorded during these four cycles of 3-dot feeding corresponds to the upper-edge transitional portion.

Following the upper-edge transitional routine, the operation proceeds to an intermediate routine in which 11-dot constant feeding is performed; dots are recorded using nozzle Nos. 1–11. A method in which sub-scanning is accomplished using constant feed increments in this manner is referred to as "constant feeding." Such secondary-scan feeding in 11-dot increments corresponds to the second sub-scanning mode. The area (see FIG. 8) on the printing paper P over which images are recorded during such secondary-scan feeding in 11-dot increments corresponds to the intermediate portion.

In FIG. 8, two nozzles pass over the $79^{th}$ or $80^{th}$ raster line from the top in the course of main scanning during printing. For raster lines over which two or more nozzles pass during printing, only one of the nozzles records a dot. It is assumed herein that the dot is recorded by the last nozzle passing over the raster lines. The raster lines should preferably be recorded by the nozzles passing over the raster line as late as possible after the operation has been switched to the upper-edge transitional routine or intermediate routine. The upper-edge transitional routine or intermediate routine employs more nozzles than does the upper-edge routine. This prevents the characteristics of a small number of nozzles from having a pronounced effect on the printing results and makes it possible to expect better image quality from the printing operation.

As a result of such printing, the area from the seventh to the $51^{st}$ raster line (as counted from the uppermost of the raster lines on which dots can be recorded by the print head) is recorded solely by nozzle Nos. 1, 2, 3 (fourth nozzle group Nr). The $25^{th}$ greater raster lines are recorded using Nos. 1–11 (nozzle groups Nr, Ni, Nh, Nf). The relation between these raster lines the printing paper P, the effect thereof, will be described below.

In the first image printing mode, images can be recorded without blank spaces up to the upper edge of the printing paper. As described above, the first image printing mode is such that images can be recorded by selecting the seventh and greater raster lines (printable area), as counted from the upstream edge in the sub-scanning direction, from among the raster lines on which dots can be recorded by the nozzles of the print head 28 (see FIG. 7). Consequently, images could theoretically be recorded very close to the upper edge of printing paper by starting dot recording after the printing paper is positioned relative to the print head 28 such that the seventh raster line (as counted from the upper edge) is disposed exactly at the position occupied by the upper edge of the printing paper. There are, however, cases in which the feed increment errors occur during feeding in the sub-scanning direction. There are also cases in which the direction in which ink droplets are ejected shifts away as a result of a manufacturing error or another factor related to the print head. The formation of blank spaces along the upper edge of the printing paper should preferably be prevented in cases in which the position at which the ink droplets are ejected on the printing paper is shifted for these reasons. It is thus assumed with reference to the first image printing mode that the image data D used for printing are provided starting from the seventh raster line, which is counted from the upstream edge in the sub-scanning direction and is selected from the raster lines on which dots can be recorded by the nozzles of the print head 28, and that printing is started from a state in which the upper edge of the printing paper P assumes the position occupied by the 23rd raster line, as counted from the upstream edge in the sub-scanning direction. Consequently, the prescribed position occupied by the upper edge of the printing paper in relation to each raster line during the start of printing coincides with the position occupied by the 23rd raster line, as counted from the upstream edge in the sub-scanning direction (FIG. 7). In the first embodiment, 16 raster lines are selected for the width (see FIG. 6) of the portion of image data D provided up to the area outside the printing paper P beyond the upper edge Pf of the printing paper P. Similarly, 24 raster lines are selected for the width of the portion of image data D provided up to the area outside the printing paper P beyond the lower edge Pr of the printing paper P. The raster lines disposed along the lower edge will be described below.

Figure 9:
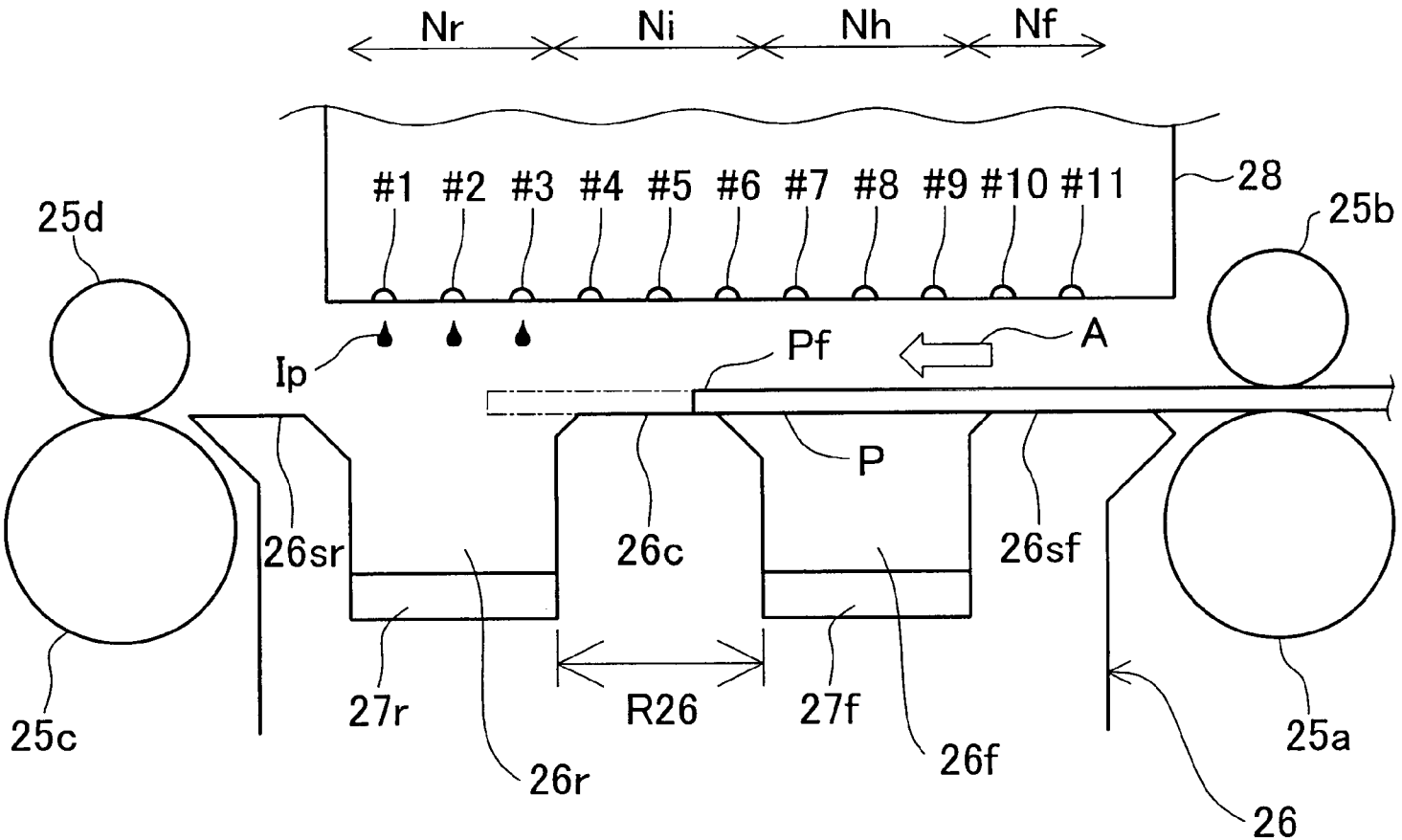
FIG. 9 is a side view depicting the relation between the print head 28 the printing paper P at the start of printing.

FIG. 9 is a side view depicting the relation between the print head 28 the printing paper P at the start of printing. Here, the central support 26*c* of the platen 26 is provided within a range R26 that extends from an downstream position corresponding to two raster lines (as counted from nozzle No. 4 of the print head 28) to an upstream position corresponding to two raster lines (as counted from nozzle No. 6). The upstream slot 26*f* is provided within a range that extends from a downstream position corresponding to a single raster line (as counted from nozzle No. 7) to an upstream position corresponding to two raster lines (as counted from nozzle No. 9). The downstream slot 26*r* is provided within a range that extends from a downstream position corresponding to two raster lines (as counted from nozzle No. 1) to an upstream position corresponding to two raster lines (as counted from nozzle No. 3). Consequently, the ink droplets Ip from nozzle Nos. 1, 2, 3 l in the downstream slot 26*r*, the ink droplets from nozzle Nos. 7, 8, 9 l in the downstream slot 26*r* when the ink droplets are ejected from the nozzles in the absence of printing paper. In other words, the ink droplets from these nozzles are prevented from depositing on the central support 26*c* of the platen 26.

The fourth nozzle group Nr shown above in FIGS. 4 5 is composed of nozzle Nos. 1, 2, 3 shown in FIG. 9. The downstream slot 26*r* (see FIG. 5) is disposed underneath the portion passed over by these nozzles during main scanning. Printing is started when the upper edge Pf of the printing paper P reaches the position above the downstream slot 26*r* shown by the solid line in FIG. 9.

As described above, the upper edge Pf of the printing paper P reaches the position of the 23*rd* raster line (as counted from the upstream edge in the sub-scanning direction), which is one of the raster lines on which dots are recorded by the nozzles of the print head 28. Specifically, it follows from FIG. 9 that the upper edge of the printing paper P reaches a rearward position corresponding to two raster lines, as counted from nozzle No. 6. If it is assumed that printing starts at this position, then the raster line belonging to the uppermost tier of the printable area (ninth raster line from the top in FIG. 7) is supposed to be recorded by nozzle No. 3, but the printing paper P has not yet reached the area underneath nozzle No. 3. The result is that accurate feeding of the printing paper P by the upstream paper feed rollers

25*a* and 25*b* will allow the ink droplets Ip ejected by nozzle No. 3 to descend directly into the downstream slot 26*r*. The same applies to recording images in the area extending up to the $16^{th}$ raster line from the top of the printable area (up to the $22^{nd}$ raster line from the top in FIG. 7).

There are also cases in which the upper edge of the printing paper P reaches the position occupied by the 22nd raster line or by upper raster line if the feed increment of the printing paper P exceeds the designed increment for any reason. The first image printing mode is configured such that nozzle Nos. 1, 2 and 3 are still capable of ejecting ink droplets Ip to cover the aforementioned raster lines in such cases, making it possible to record images along the upper edge of the printing paper P and to prevent blank spaces from forming. Specifically, blank spaces can be prevented from forming along the upper edge of the printing paper P when the feed increment of the printing paper P exceeds the designed increment but the excessive feed increment is still no more than 16 raster lines, as shown by the dashed line in FIG. 9.

Another possibility is that the feed increment of the printing paper P falls short of the designed increment for any reason. In such cases the printing paper fails to arrive at the designated position, and the ink droplets Ip end up depositing on the underlying structure. In the first image printing mode, the 29 raster lines along the intended upper-edge position of the paper sheet (by 51st line in FIG. 8) are recorded by nozzle Nos. 1, 2 and 3, as shown in FIG. 7 and FIG. 8. A downstream slot 26*r* is disposed underneath these nozzles, so the ink droplets Ip descend into the downstream slot 26*r* and are absorbed by an absorbent member 27*r* if they fail to deposit on the printing paper P. It is thus possible to prevent situations in which the ink droplets Ip deposit on the upper surface of the platen 26 and subsequently soil the printing paper. Specifically, adopting the present embodiment makes it possible to prevent situations in which the ink droplets Ip deposit on the upper surface of the platen 26 and subsequently soil the printing paper P when the upper edge Pf of the printing paper P moves past the intended position of the upper edge during the start of printing but the deviation of the paper from the intended position of the upper edge is still no more than 29 raster lines.

In the first embodiment, the intermediate printing routine is carried out using all the nozzles. Fast printing can therefore be achieved during the intermediate routine.

Another feature of the first embodiment is that feeding is performed as part of sub-scanning in the same manner as in the upper-edge routine with the aid of all the nozzles (as in the intermediate routine) in the course of an upper-edge transitional routine that follows the upper-edge routine but precedes the intermediate routine. A transfer from the upper-edge routine to the intermediate routine can therefore be accomplished in a smooth manner without reversing the feed direction during sub-scanning. High-quality printing results can thus be obtained.

The above-described results can be obtained by adopting an arrangement in which ink droplets are ejected from at least some of the nozzles belonging to the fourth nozzle group Nr (fourth sub-group of dot-forming elements), dots are formed on a printing paper P when the upper edge of the printing paper P passes above the opening of the downstream slot 26*r* during the printing of images along the upper edge of the printing paper P.

The above-described upper-edge routine, which is based on the action of the fourth nozzle group Nr (nozzle Nos. 1, 2, 3), is performed by a CPU 41 (see FIG. 3), as are the upper-edge transitional routine intermediate routine, which are based on the action of nozzle groups Nr, Ni, Nh, Nf (nozzle Nos. 1–11). In other words, the CPU 41 functions as the upper-edge printing unit, upper-edge transitional printing unit, intermediate printing unit. The upper-edge printing unit 41*p*, upper-edge transitional printing unit 41*q*, intermediate printing unit 41*r* are shown in FIG. 3 as functional units of the CPU 41.

(2) Lower-edge Transitional Routine Lower-edge Routine

Figure 10:
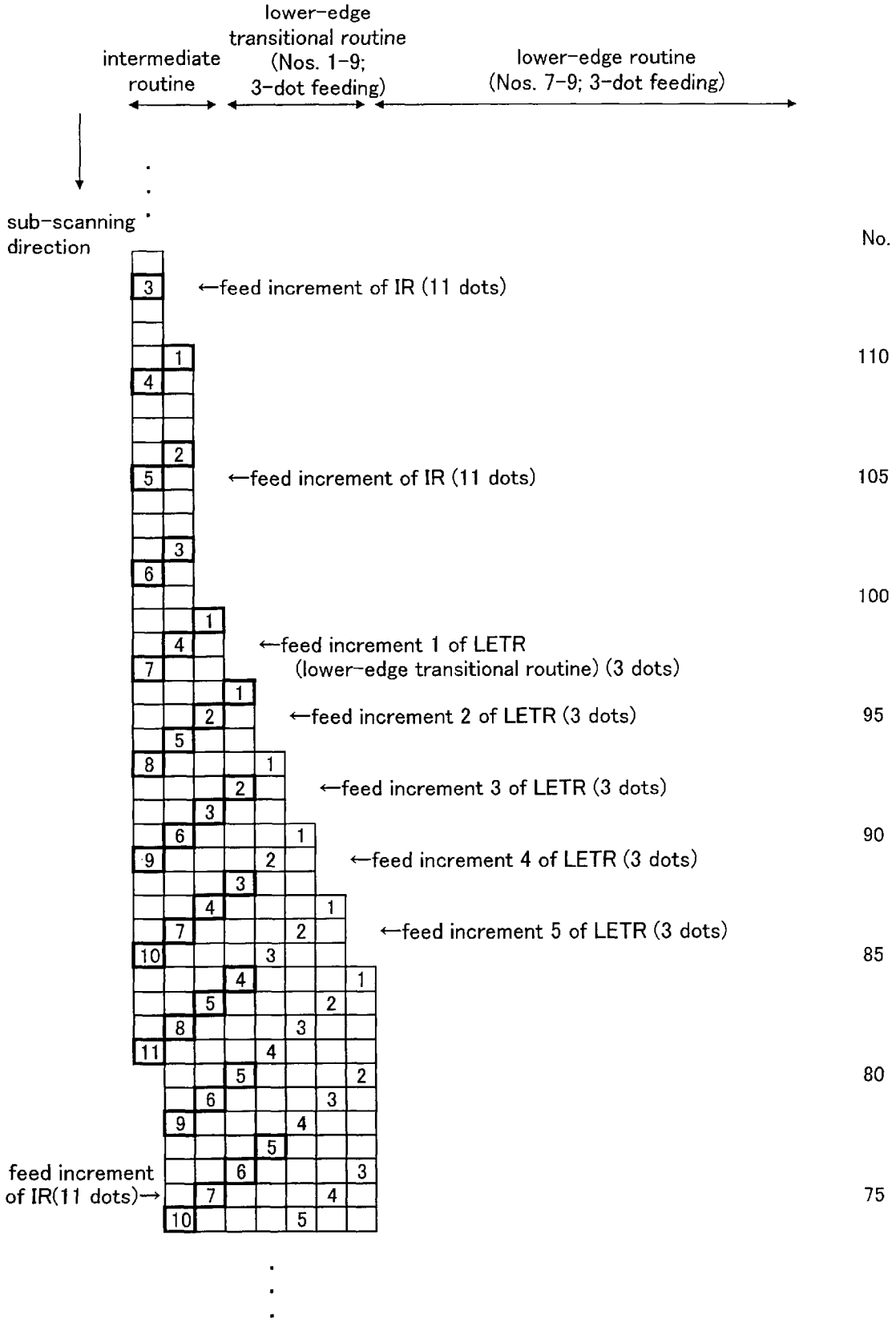
FIG. 10 is a diagram depicting the manner in which raster lines are recorded by particular nozzles during the intermediate routine lower-edge transitional routine.
Figure 11:
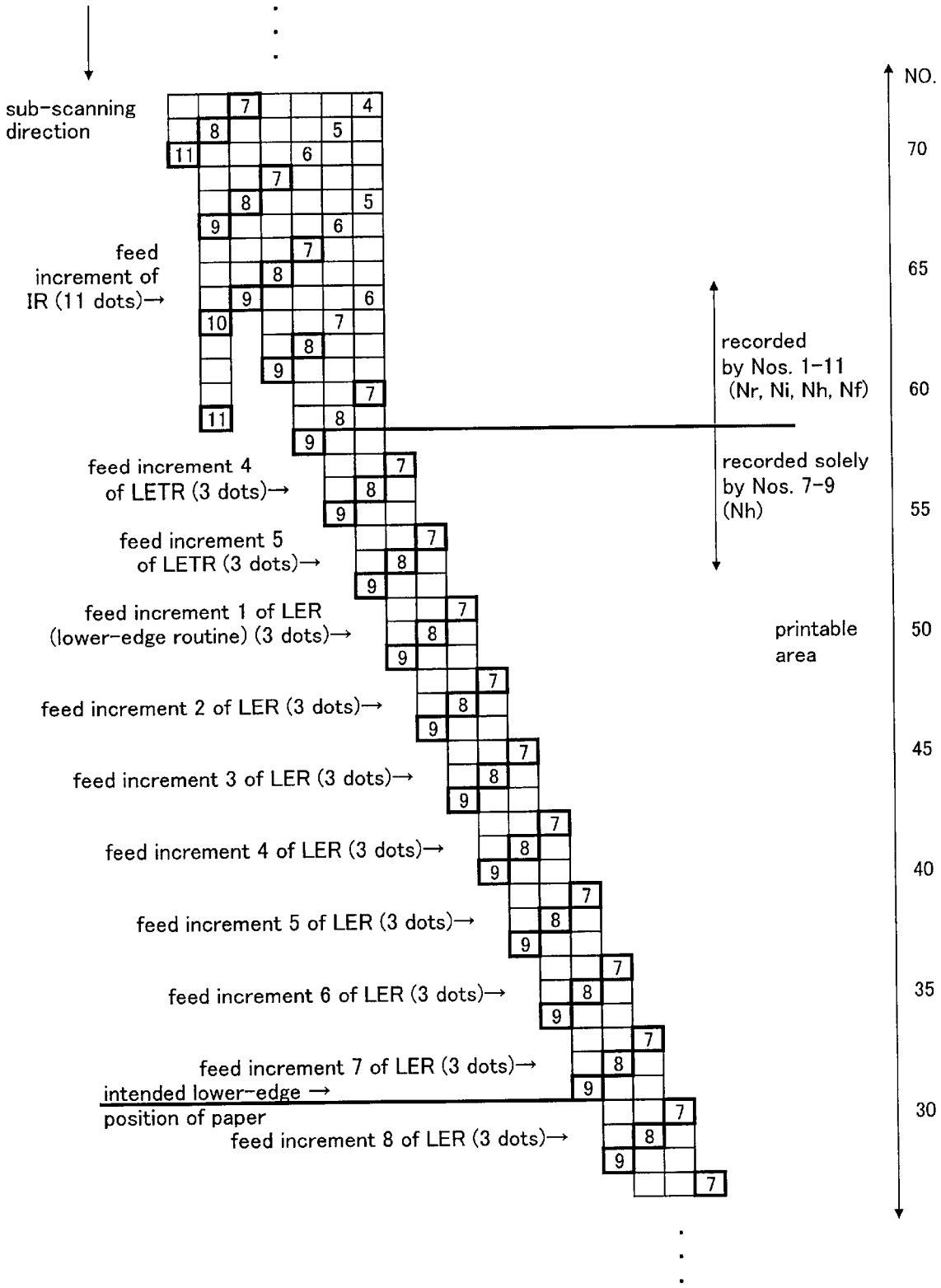
FIG. 11 is a diagram depicting the manner in which raster lines are recorded by particular nozzles during the intermediate routine, lower-edge transitional routine, lower-edge routine.
Figure 12:
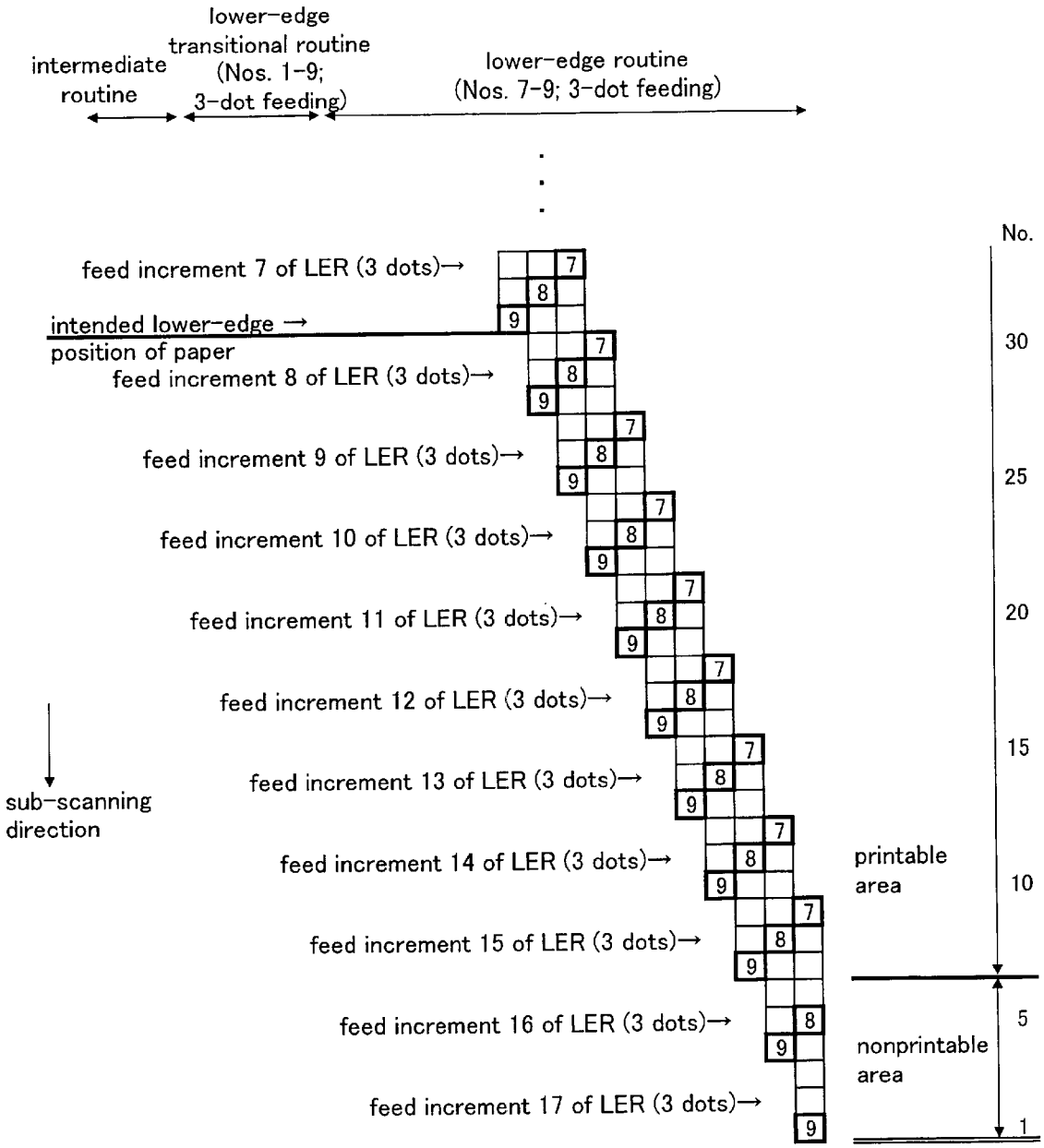
FIG. 12 is a diagram depicting the manner in which raster lines are recorded by particular nozzles during the lower-edge routine.

FIGS. 10 to 12 are diagrams depicting the manner in which raster lines are recorded by particular nozzles during the lower-edge transitional routine and collect, don't change . In the first embodiment, regular 11-dot feeding is performed using all the nozzles during the intermediate routine, after which 3-dot feeding is repeated five times dots are formed using nozzle Nos. 1–9 (nozzle groups Nr, Ni, Nh) during the lower-edge transitional routine, as shown in FIG. 10. In other words, the first nozzle group Nf (nozzle Nos. 10 11) are left unused during the lower-edge transitional routine. The area (see FIGS. 10 11) on the printing paper P over which images are recorded during the five cycles of 3-dot feeding corresponds to the lower-edge transitional portion.

Three-dot increments are repeated 17 times dots are formed using solely nozzle Nos. 7–9 (second nozzle group Nh) during the lower-edge routine that follows the lower-edge transitional routine, as shown in FIGS. 11 12. This 3-dot constant feeding corresponds to the third sub-scanning mode. The area (see FIGS. 11 12) on the printing paper P over which images are recorded during the 17 cycles of 3-dot feeding corresponds to the lower-edge portion. The upper-edge portion, upper-edge transitional portion, intermediate portion, lower-edge transitional portion, lower-edge portion of the printing paper P are aligned in sequence on the surface portion of the printing paper P while partially overlapping each other.

Except for some raster lines, each of the raster lines aligned in the main scanning direction is recorded with a single nozzle when such feeding is carried out. In FIGS. 10 to 12, the raster lines on which dots can be recorded by the nozzles of the print head 28 are designated with symbols, which are shown in sequence from the bottom on the right side of the drawing. The same applies to the drawings used hereinbelow in order to illustrate the recording of dots during the lower-edge routine.

In FIG. 12, no nozzles pass over the second, third, or sixth raster line (as counted from the lowermost tier) when the system moves in the main scanning direction during printing. Consequently, the printable area in the lower-edge portion of the printing paper extends over seven or more raster lines from the lowermost tier.

In FIG. 10, two or more nozzles pass over, for example, the $80^{th}$ or $81^{st}$ raster line from the bottom in the course of main scanning during printing. The same applies, for example, to the $59^{th}$ or $63^{rd}$ nozzle from the bottom in FIG. 11. It is assumed with respect to a raster line over which two or more nozzles pass during printing in this manner that the last nozzle passing over the raster line records a dot. With such a raster line, the dot should preferably be recorded on the raster line during the intermediate routine or lower-edge transitional routine. The intermediate routine or lower-edge transitional routine is performed using a greater number of nozzles than in the case of the lower-edge routine. This prevents the characteristics of a small number of nozzles from having a pronounced effect on the printing result which makes it possible to expect better image quality from the printing operation.

As a result of such printing, the area up to the $58^{th}$ raster line (as counted from the lowermost of the raster lines on which dots can be recorded by the print head) is recorded solely by nozzle Nos. 7, 8, 9 (second nozzle group Nh), as shown in FIGS. 11 12. The $59^{th}$ greater raster lines are recorded using Nos. 1–11 (nozzle groups Nr, Ni, Nh, Nf). The relation between these raster lines and the printing paper P, the effect thereof, will be described below.

In the first image printing mode, images can be recorded without blank spaces up to the lower edge in the same manner for the upper edge. As described above, the image printing mode is such that images can be recorded by selecting the seventh and greater raster lines (printable area), as counted from the downstream edge in the sub-scanning direction, from among the raster lines that can be used to record dots by the nozzles of the print head 28. It is assumed, however, that images are recorded on the printing paper starting from the 31st raster line (as counted from the downstream edge in the sub-scanning direction) because of considerations related, among other things, to the feed increment errors that occur during feeding in the sub-scanning direction. Specifically, ink droplets Ip are ejected over the 30th raster line and greater raster lines, and the final main scan of the printing operation is performed in a state in which the lower edge of the printing paper is at a position corresponding to the 31st raster line, as counted from the upstream edge in the sub-scanning direction. Consequently, the intended position of the lower edge of the printing paper in relation to each raster line during the end of printing coincides with the position occupied by the 31*st* raster line, as counted from the downstream edge in the sub-scanning direction (FIG. 11).

Figure 13:
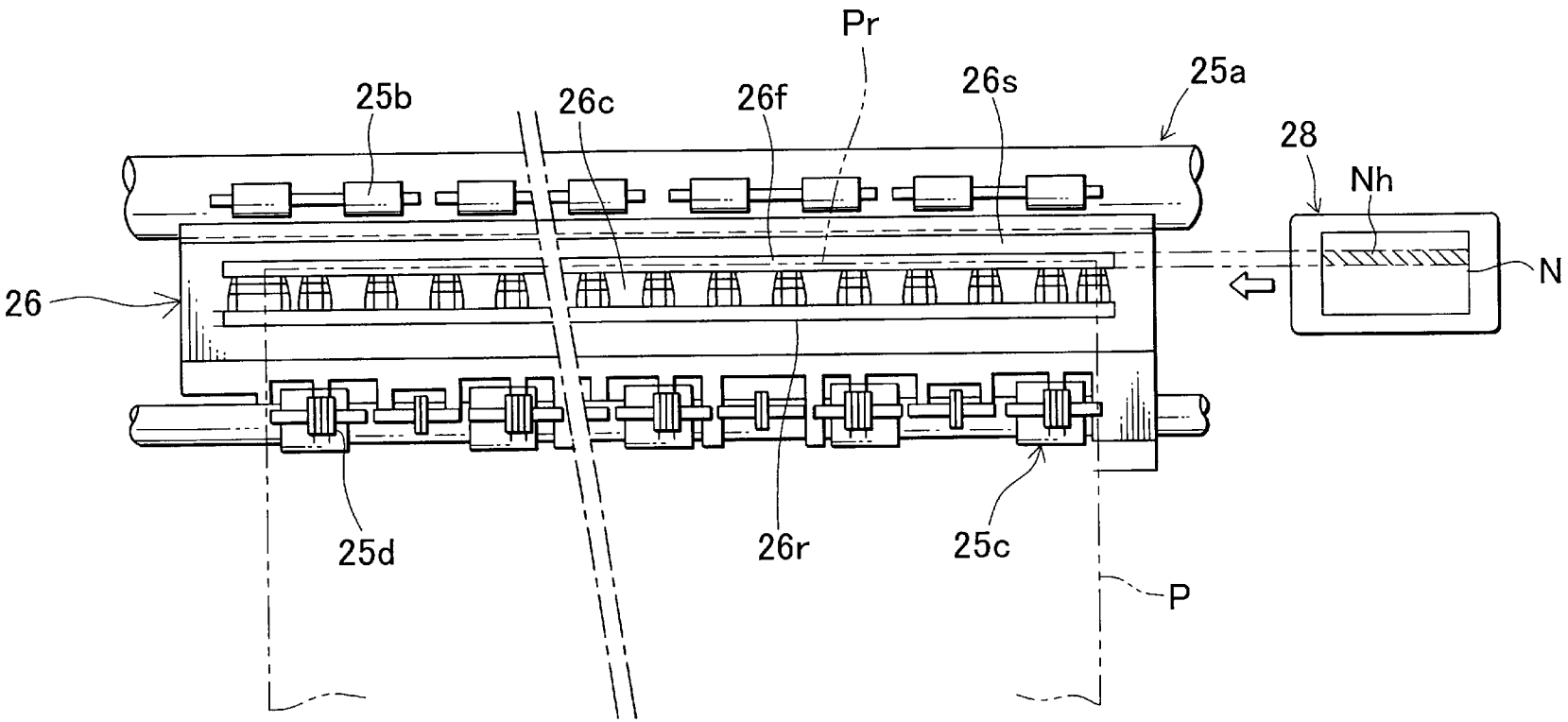
FIG. 13 is a plan view depicting the relation between the printing paper P an upstream slot 26*f* during printing in the lower-edge portion Pr of the printing paper P.

FIG. 13 is a plan view depicting the relation between the printing paper P and upstream slot 26*f* during printing in the lower-edge portion Pr of the printing paper P. In FIG. 13, the nozzles Nf in the hatched area of the print head 28 correspond to the area in which nozzle Nos. 7, 8 and 9 are located. An upstream slot 26*f* is disposed underneath the area over which these nozzles pass during a main scan, and dot recording on the printing paper P is completed when the lower edge Pr of the printing paper P reaches the position shown by the dashed line above the upstream slot 26*f*.

Figure 14:
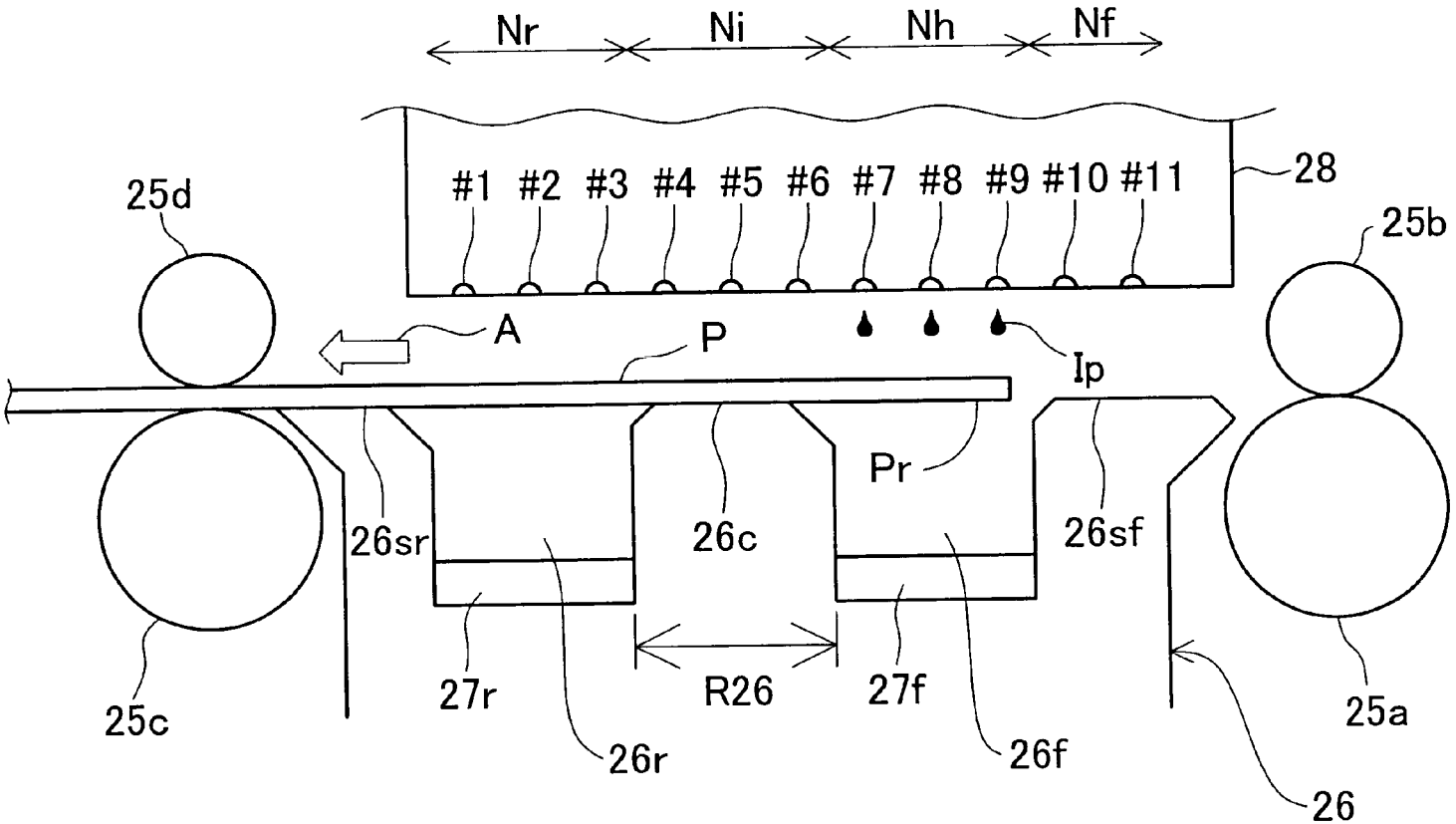
FIG. 14 is a side view depicting the relation between the printing paper P the print head 28 during printing along the lowermost edge of the printing paper.

FIG. 14 is a side view depicting the relation between the printing paper P and print head 28 during printing in the lower-edge portion Pr of the printing paper P. When images are printed in the lower-edge portion Pr of the printing paper P, the lower edge Pr of the printing paper P is disposed at the position occupied by the 31st raster line (as counted from the downstream edge in the sub-scanning direction), which is a raster line on which dots can be recorded by the nozzles of the print head 28, as described above (see FIG. 12). Specifically, the lower edge of the printing paper P is disposed immediately below nozzle No. 9 when the raster lines along the lower edge of the printing paper P are recorded. Consequently, the ejected ink droplets Ip drop directly into the upstream slot 26*f* when the system is subsequently fed in the course of sub-scanning the ink droplets are ejected by nozzle Nos. 7–9.

If the feed increment of the printing paper P falls below the designed increment for any reason, nozzle Nos. 7, 8 and 9 move beyond the lower edge Pr of the printing paper P and discharge ink droplets Ip for the designated raster lines (seventh to 30th raster lines from bottom in FIG. 13), making it possible to record images along the lower edge Pr of the printing paper P without leaving any blank spaces. Specifically, blank spaces can be prevented from forming along the lower edge of the printing paper P when the deficit of the feed increment is no more than 24 raster lines.

The 28 raster lines (31st to 62nd raster lines in FIG. 13) along the intended upper-edge position of the paper sheet are recorded by nozzle Nos. 7, 8 and 9. It is therefore possible to prevent situations in which the ejected ink droplets Ip fall into the upstream slot 26*f* and deposit in the area occupied by the upper surface of the platen 26 when the feed increment of the printing paper P falls below the designed increment for any reason.

The above-described results can be obtained by adopting an arrangement in which ink droplets are ejected from at least some of the nozzles belonging to the second nozzle group Nh (second sub-group of dot-forming elements), dots are formed on a printing paper P when the lower edge of the printing paper P passes above the opening of the upstream slot 26*f* during the printing of images along the lower edge of the printing paper P.

In the first embodiment, the intermediate printing routine is carried out using all the nozzles. Fast printing can therefore be achieved during the intermediate routine.

Another feature of the first embodiment is that nozzle groups Nh, Ni, Nr (nozzle Nos. 1–9) alone are used in the course of a lower-edge transitional routine that follows the intermediate routine but precedes the lower-edge routine. Specifically, the first nozzle group Nf (nozzle Nos. 10 11), which is disposed upstream from the second nozzle group Nh used in the lower-edge routine, remains unused in this case. A transfer from the intermediate routine to the lower-edge routine can therefore be accomplished in a smooth manner without reversing the feed direction during sub-scanning. High-quality printing results can thus be obtained.

The above-described lower-edge transitional routine, which is based on the action of nozzle groups Nh, Ni, Nr (nozzle Nos. 1–9), is performed by a CPU 41 (see FIG. 3), as is the lower-edge routine, which is based on the action of the second nozzle group Nh (nozzle Nos. 7, 8, 9). In other words, the CPU 41 functions as the lower-edge transitional printing unit lower-edge printing unit. T he lower-edge transitional printing unit 41*s* lower-edge printing unit 41*t* are shown in FIG. 3 as functional units of the CPU 41.

C. Second Embodiment

Figure 15:
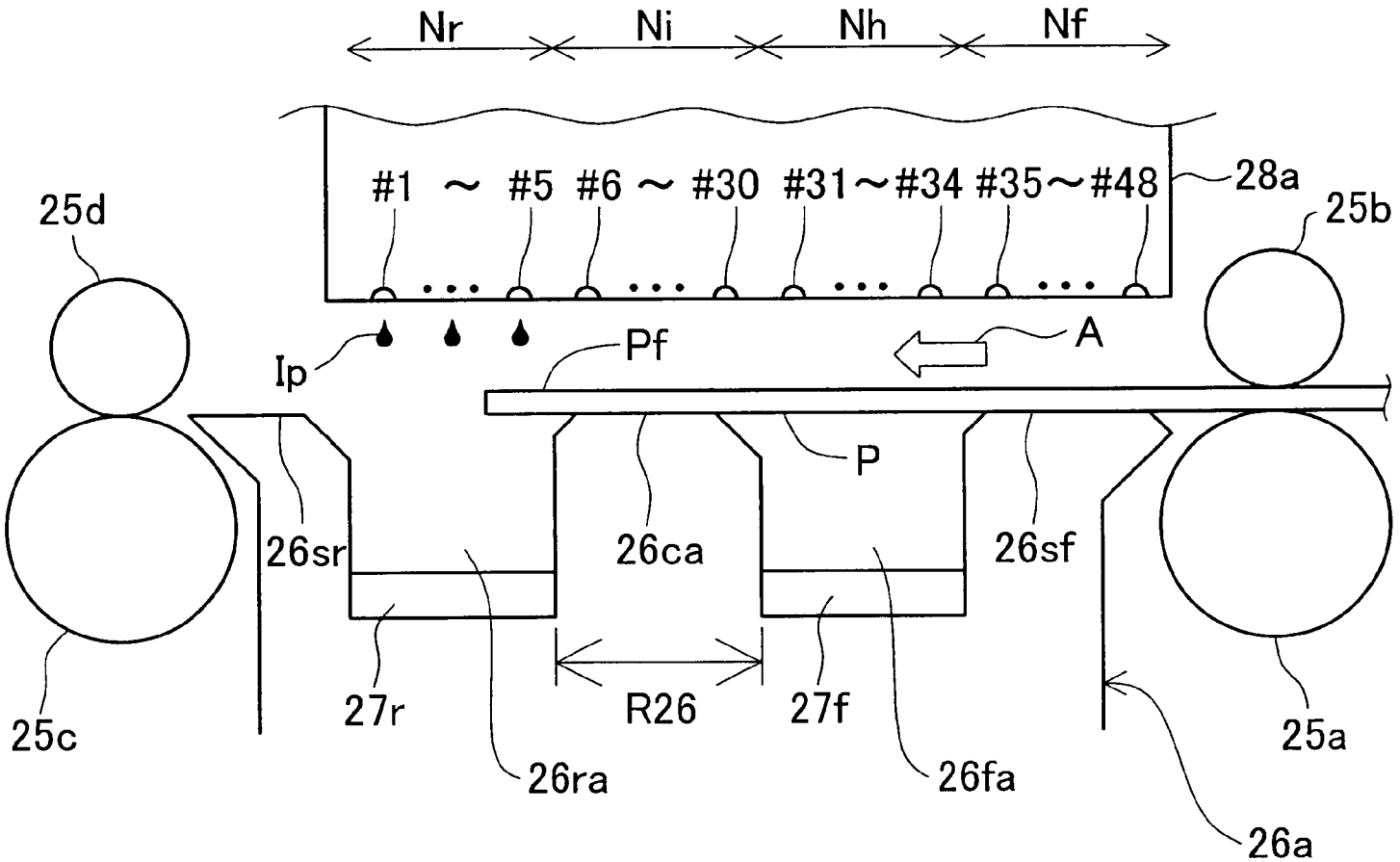
FIG. 15 is a side view depicting the relation of a print head 28*a*with an upstream slot 26*fa* a downstream slot 26*ra* according to a second embodiment.

FIG. 15 is a side view depicting the relation between the print head 28*a* the upstream lateral slot 26*fa* downstream lateral slot 26*ra* according to a second embodiment. The description that follows will concern a printing device in which a single row of nozzles comprises 48 nozzles. In the first embodiment, constant feeding was performed during sub-scanning, whereas the second embodiment envisages performing non-constant feeding. Non-constant feeding is a method in which sub-scanning is performed by combining different feed increments. Another feature of the second embodiment is that each raster line is recorded by two different nozzles through two cycles of main scanning. A method in which the pixels within a single raster line are printed by a plurality of nozzles in distributed fashion in this manner will be referred to as "overlap printing." With such overlap printing, the dots of a single raster line are recorded by a plurality of nozzles passing over this raster line during a plurality of main scans for which the positions of printing paper in the sub-scanning direction are mutually different in relation to the print head.

In the printing device of the second embodiment, the upstream support 26*sf* is disposed opposite nozzle Nos. 35–48 (first nozzle group Nfa) in the sub-scanning direction. The upstream slot 26*fa* is disposed opposite nozzle Nos. 31–34 (second nozzle group Nha). The central support 26*ca* is disposed opposite nozzle Nos. 6–30 (third nozzle group Nia). The downstream slot 26*ra* is disposed opposite nozzle Nos. 1–5 (fourth nozzle group Nra). The other structural features are the same as those of the printing device pertaining to the first embodiment.

The first nozzle group Nfa of the second embodiment corresponds to the first sub-group of dot-forming elements, the second nozzle group Nha corresponds to the second sub-group of dot-forming elements. The third nozzle group Nia corresponds to the third sub-group of dot-forming elements, the fourth nozzle group Nra corresponds to the fourth sub-group of dot-forming elements. Here, the sub-groups of dot-forming elements of each nozzle array are collectively treated as nozzle groups Nfa, Nha, Nia, Nra.

(1) Upper-edge Routine, Upper-edge Transitional Routine, Intermediate Routine

Figure 16:
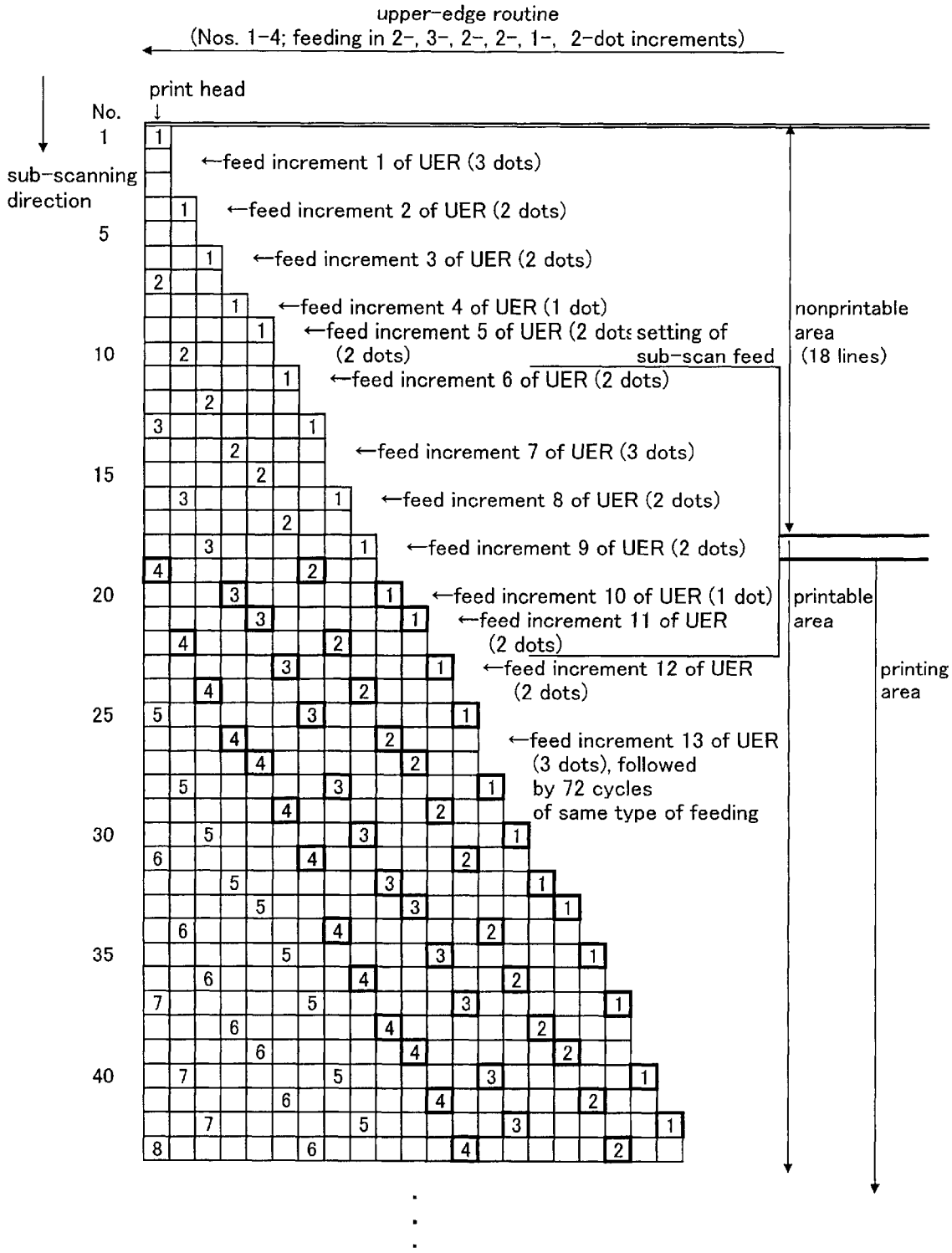
FIG. 16 is a diagram depicting the manner in which raster lines are recorded by particular nozzles during the upper-edge routine of the second embodiment.

FIG. 16 is a diagram depicting the manner in which raster lines are recorded by particular nozzles during the upper-edge routine of the second embodiment. According to the upper-edge routine of the second embodiment, 2-, 3-, 2-, 2-, 1-, 2-dot feed increments are repeated 72 times with the aid of the fourth nozzle group Nra (nozzle Nos. 1–5) in the order indicated, as shown in FIG. 16. In practice, nozzle No. 5, which belongs to the fourth nozzle group Nra, remains unused. At the start of feeding during sub-scanning, feeding in 3-, 2-, 2-, 1-, 2-dot increments is performed during sub-scanning, with the initial 2-dot feeding omitted. The non-constant feeding that involves 2, 3, 2, 2, 1, 2 dots is performed during the upper-edge routine corresponds to the first sub-scanning mode. In the drawings, the nozzles within bold boxes are used for recording dots on raster lines.

The upper-edge routine is followed by an upper-edge transitional routine, which is performed using all the nozzles (nozzle Nos. 1–48 from the nozzle groups Nra, Nia, Nha, Hfa), with the non-constant feeding that involves 2, 3, 2, 2, 1, 2 dots preserved unchanged. A total of 12 cycles of feeding are performed during sub-scanning in the course of the upper-edge transitional routine.

Figure 17:
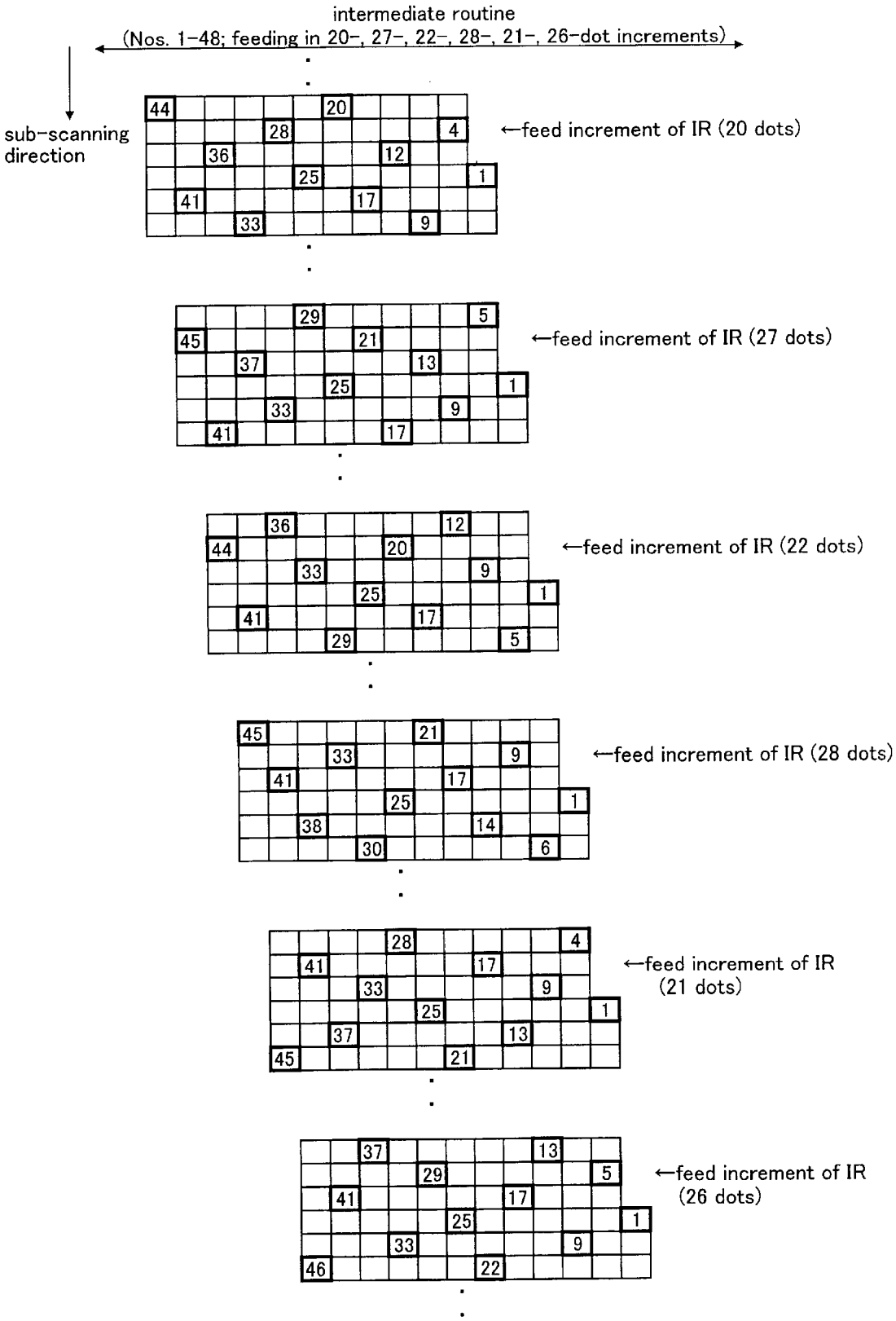
FIG. 17 is a diagram depicting the manner in which raster lines are recorded by particular nozzles during the intermediate routine of the second embodiment.

FIG. 17 is a diagram depicting the manner in which raster lines are recorded by particular nozzles during the intermediate routine of the second embodiment. After the upper-edge transitional routine, the operation proceeds to an intermediate routine such as the one shown in FIG. 17, non-constant feeding in 20-, 27-, 22-, 28-, 21-, 26-dot increments is repeated using all the nozzles (nozzle Nos. 1–48 from the nozzle groups Nra, Nia, Nha, Hfa). This type of non-constant feeding corresponds to the second sub-scanning mode. Other feed methods may also be employed, provided the maximum sub-scan feed amount of the second sub-scanning mode performed according to the intermediate routine is greater than the maximum sub-scan feed amount of the upper-edge routine.

As a result of such feeding, each raster line is recorded by two nozzles in the course of two main scans. For a raster line over which three or more nozzles pass (such as the 25*th* or 28*th* raster line from the top), dots are recorded solely by the last two nozzles passing over the raster line, as shown in FIG. 16.

As shown in FIG. 16, in the second embodiment, images can be recorded by selecting the 19*th* and greater raster lines (printable area), as counted from the upstream edge in the sub-scanning direction, from among the raster lines on which dots can be recorded by the nozzles of the print head 28. The image data D used for printing are provided starting from the 19*th* raster line, as counted from the upstream edge in the sub-scanning direction. For the same reasons as those described with reference to the first embodiment, printing is started when the upper edge of the printing paper P reaches the position upstream raster line rather than the 19*th* raster line, as counted from the upstream edge in the sub-scanning direction. Consequently, the second embodiment entails providing image data D beyond the intended position of the upper edge of the printing paper P.

In the second embodiment, all the nozzles are used to perform printing according to the intermediate routine. Printing can therefore be performed at a higher speed than when only some of the nozzles are used. According to the second embodiment, an upper-edge transitional routine, which is characterized by the same type of feeding (one that involves 2, 3, 2, 2, 1 2 dots) as that adopted for the upper-edge routine, is performed using all the nozzles (as in the intermediate routine) between the upper-edge routine the intermediate routine. This dispenses with the need to reverse the feed direction during a transfer from the upper-edge routine to the intermediate routine allows printing to be accomplished in a smooth manner. High-quality printing results can thus be obtained.

(2) Lower-edge Transitional Routine and Lower-edge Routine

Figure 18:
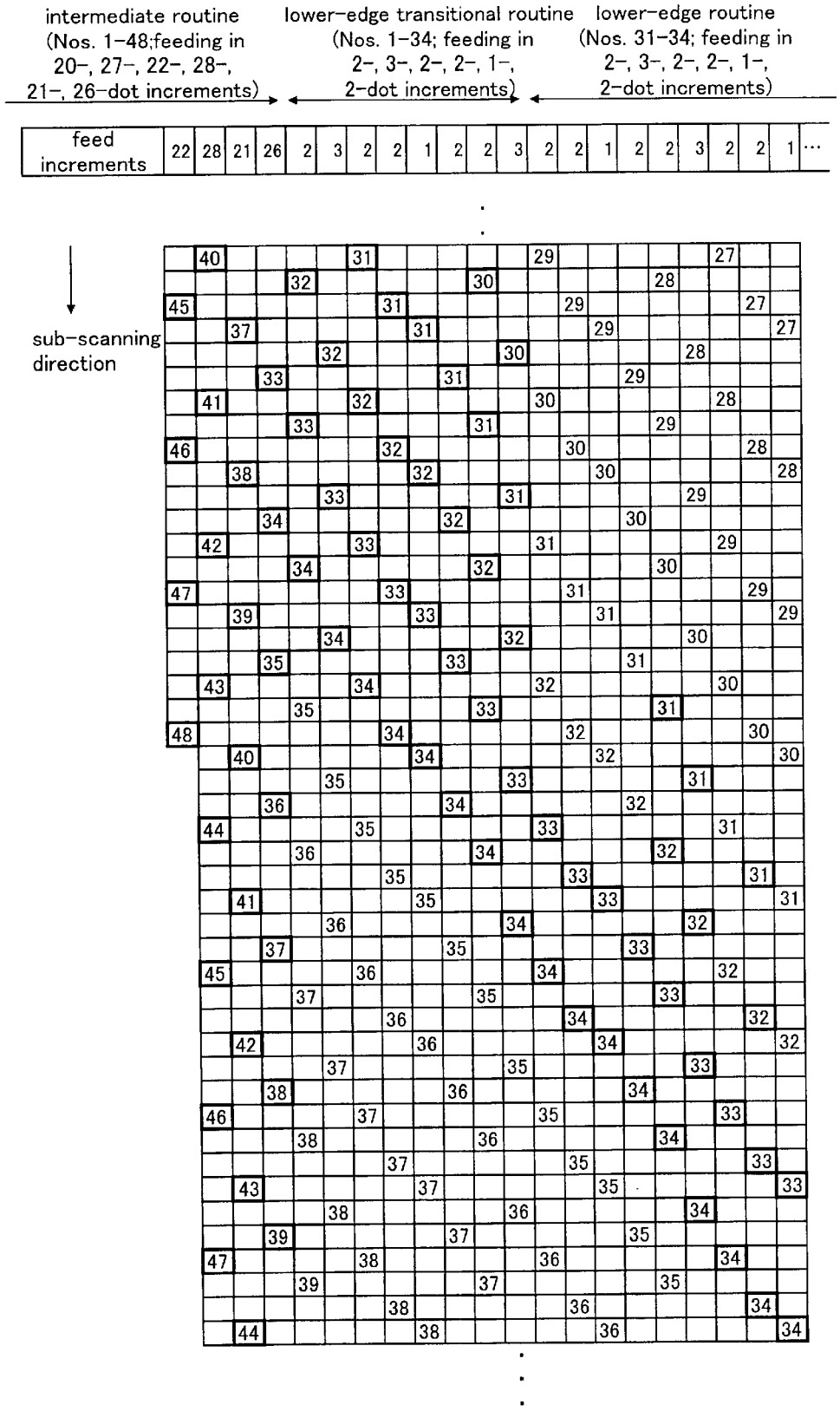
FIG. 18 is a diagram depicting the manner in which raster lines are recorded By particular nozzles during the intermediate routine, lower-edge transitional routine, lower-edge routine of the second embodiment.
Figure 19:
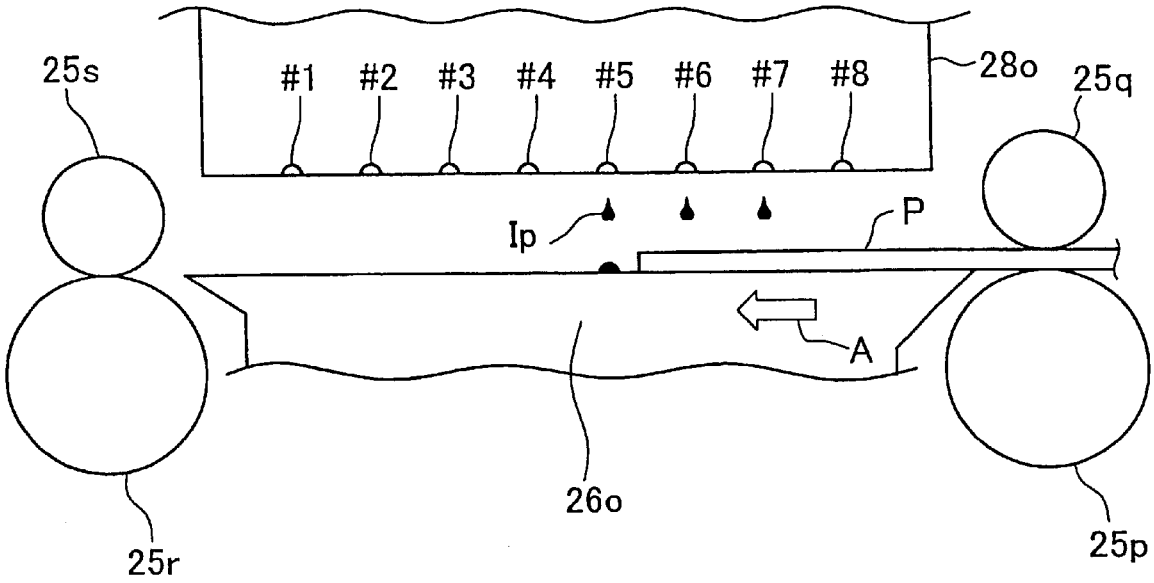
Fig. 19 (PRIOR ART)
FIG. 19 is a side view depicting the periphery of a print head for a conventional printer.

FIG. 18 is a diagram depicting the manner in which raster lines are recorded by particular nozzles during the intermediate routine, lower-edge transitional routine, lower-edge routine of the second embodiment. The table in the upper part of the drawing shows the feed increments of sub-scanning for each routine. In the second embodiment, non-constant feeding in 20-, 27-, 22-, 28-, 21-, 26-dot increments is repeated using all the nozzles in the course of the intermediate routine, feeding in 2-, 3-, 2-, 2-, 1-, 2-dot increments is then repeated eight times (eight cycles involving 2, 3, 2, 2, 1, 2, 2, 3 dots) with the aid of nozzle Nos. 1–34 (nozzle groups Nra, Nia, Nha) in accordance with the lower-edge transitional routine in the order indicated, as shown in FIG. 18. Feeding in 2-, 3-, 2-, 2-, 1-, 2-dot increments is then repeated using solely nozzle Nos. 31–34 (second nozzle group Nha) in the course of the lower-edge routine. The non-constant feeding in 2-, 3-, 2-, 2-, 1-, 2-dot increments corresponds to the third sub-scanning mode. When such printing is carried out, each raster line is recorded by two nozzles through two cycles of main scanning. For a raster line passed over by three or more nozzles, only two of the nozzles participate in dot formation. As a result, some of nozzle Nos. 31–34 are sometimes left unused when, for example, a particular main scan is performed in the course of a lower-edge routine.

According to the second embodiment, a lower-edge transitional routine, which is characterized by the same type of feeding (one that involves 2, 3, 2, 2, 1 2 dots) as that adopted for the lower-edge routine, is performed between the intermediate routine and the lower-edge routine without the use of the first nozzle group Nfa (nozzle Nos. 35–48), which is disposed upstream from the second nozzle group Nha. This dispenses with the need to reverse the feed direction during a transfer from the intermediate routine to the lower-edge routine which allows printing to be accomplished in a smooth manner. High-quality printing results can thus be obtained.

Another feature of the second embodiment is that non-constant feeding is performed through an upper-edge routine, upper-edge transitional routine, intermediate routine, lower-edge transitional routine, lower-edge routine. For this reason, such printing yields better quality than when constant feeding is performed. In addition, using overlap printing yields better quality than in the absence of such overlap printing.

D. Modifications

The present invention is not limited by the above-described embodiments or embodiments and can be implemented in a variety of ways as long as the essence thereof is not compromised. For example, the following modifications are possible.

D1. Modification 1

In the first embodiment, the first sub-scanning mode involved performing constant feeding in 3-dot increments, whereas the first sub-scanning mode of the second embodiment involved performing non-constant feeding in 2-, 3-, 2-, 2-, 1-, 2-dot increments. However, the feeding method of the upper- and lower-edge routines is not limited thereby and may include other constant feedings or non-constant feedings, depending on the nozzle pitch or the number of nozzles in a nozzle row. In other words, any feeding method may be adopted as long as the maximum sub-scan feed amount in the sub-scanning direction is less than the maximum sub-scan feed amount in the sub-scanning direction for the intermediate routine. In should be noted that adopting smaller feed increments in the sub-scanning direction for the upper-edge routine allows the upper edge of printing paper to be recorded with the nozzles disposed further downstream in the sub-scanning direction. The downstream slot can therefore be narrowed, and the upper platen surface for supporting the printing paper can be broadened. Similarly, adopting smaller feed increments in the sub-scanning direction for the lower-edge routine allows the upper edge of printing paper to be recorded with the nozzles disposed further upstream in the sub-scanning direction. The upstream slot can therefore be narrowed, and the upper platen surface for supporting the printing paper can be broadened.

The above embodiments were described with reference to cases in which the first and third sub-scanning modes involved performing the same type of feeding, but there is no particular need for the two modes to be the same. It is possible, for example, to configure the printer of the second embodiment such that the first sub-scanning mode involves performing non-constant feeding in 2-, 3-, 2-, 2-, 1-, 2-dot increments, the third sub-scanning mode involves performing non-constant feeding in 2-, 1-, 2-, 3-, 2-, 2-dot increments. Neither is it necessary to always perform constant feeding throughout the printing process from the upper-edge routine to the lower-edge routine (as in the first embodiment), or to always perform non-constant feeding throughout the printing process from the upper-edge routine to the lower-edge routine (as in the second embodiment). It is also possible to perform constant feeding for the first third sub-scanning modes and to perform non-constant feeding for the second sub-scanning mode. In other words, any type of feeding may be employed as long as the maximum sub-scan feed amount of sub-scanning is greater for the first third sub-scanning mode than for the second sub-scanning mode.

D2. Modification 2

The present invention can be adapted to monochromatic printing in addition to color printing. The use of the present invention is not limited to ink-jet printers alone but commonly includes all dot-recording devices in which images are recorded on the surface of a print medium by a print head having a plurality of dot-forming element arrays. As used herein, the term "dot-forming element" refers to a dot-forming constituent element such as an ink nozzle of an ink-jet printer.

D3. Modification 3

In the above embodiments, software can be used to perform some of the functions carried out by hardware, or, conversely, hardware can be used to perform some of the functions carried out by software. For example, a host computer 90 can be used to perform some of the functions carried out by the CPU 41 (FIG. 3).

The computer programs for performing such functions may be supplied as programs stored on floppy disks, CD-ROMs, and other types of computer-readable recording media. The host computer 90 may read the computer programs from these recording media and transfer the data to internal or external storage devices. Alternatively, the computer programs can be installed on the host computer 90 from a program-supplying device via a communications line. Computer programs stored by an internal storage device are executed by the host computer 90 when the functions of the computer programs are to be performed. Alternatively, computer programs stored on a storage medium may be executed directly by the host computer 90.

As used herein, the term "host computer 90" refers both to a hardware device and to an operating system, and designates a hardware device capable of operating under the control of an operating system. Computer programs allow such a host computer 90 to perform the functions of the above-described units. Some of the aforementioned functions can be performed by an operating system rather than an application program.

As used herein, the term "computer-readable recording medium" is not limited to a portable recording medium such as a floppy disk or a CD-ROM and includes various RAMs, ROMs, and other internal computer storage devices as well as hard disks and other external storage devices fixed to the computer.

What we claimed is:

1. A dot-recording device for recording ink dots on a surface of a print medium, wherein the surface of the print medium being dividable in order from a front edge, into a front-edge portion containing the front edge, a front-edge transitional portion, an intermediate portion, a rear-edge transitional portion, and a rear-edge portion containing a rear edge, the dot recording device recording with the aid of a dot-recording head provided with a group of dot-forming elements for ejecting ink droplets, the dot-recording device comprising:

a main scanning unit configured to drive the dot-recording head and/or the print medium to perform main scanning:

a head driver configured to drive at least some of the dot-forming elements to form dots during the main scanning;

a platen configured to extend in a main scanning direction and to be disposed opposite the dot-forming elements at least along part of a main scan path, the platen being configured to support the print medium at a position opposite the dot-recording head;

a sub-scanning unit configured to move the print medium to perform sub-scanning in between main scan paths; and a controller configured to control the dot-recording device, wherein the platen comprises:

a first support member extending in the main scanning direction, a width of the first support member in a sub-scanning direction corresponding to a first sub-scanning range on a surface of the dot-recording head including a preselected first sub-group of dot-forming elements;

a first slot extending in the main scanning direction, a width of the first slot in the sub-scanning direction corresponding to a second sub-scanning range on the surface of the dot-recording head including a preselected second sub-group of dot-forming elements, the second sub-group of dot-forming elements being disposed in the sub-scanning direction downstream from the first sub-group of dot-forming elements;

a second support member extending in the main scanning direction, a width of the second support member in the sub-scanning direction corresponding to a third sub-scanning range on the surface of the dot-recording head including a preselected third sub-group of dot-forming elements, the third sub-group of dot-forming elements being disposed in the sub-scanning direction downstream from the second sub-group of dot-forming elements; and a second slot extending in the main scanning direction, a width of the second slot in the sub-scanning direction corresponding to a fourth sub-scanning range on the surface of the dot-recording head including a preselected fourth sub-group of dot-forming elements, the fourth sub-group being disposed in the sub-scanning direction downstream from the third subgroup of dot-forming elements, wherein the controller comprises:

a front-edge printing unit configured to form dots in the front edge portion in accordance with a first sub-scanning mode using the fourth sub-group of dot-forming elements without use of any of the first to third sub-groups of dot-forming elements;

a front-edge transitional printing unit configured to form dots in the front-edge transitional portion in accordance with the first sub-scanning mode using the first to fourth sub-groups of dot-forming elements;

an intermediate printing unit configured to form dots in the intermediate portion using the first to fourth sub-groups of dot-forming elements in accordance with a second sub-scanning mode, a maximum sub-scan feed amount in the second sub-scanning mode being greater than a maximum sub-scan feed amount in the first sub-scanning mode.

2. A dot-recording device as defined in claim 1, wherein the front-edge printing unit forms dots in the front-edge portion when the print medium is supported on the platen and the front edge of the print medium is above the second slot.

3. A dot-recording device as defined in claim 1, wherein the controller further comprises:

a rear-edge transitional printing unit configured to form dots in the rear-edge transitional portion using the second to fourth sub-groups of dot-forming elements without use of the first sub-group of dot-forming elements, the dot forming being performed in accordance with a third sub-scanning mode, a maximum sub-scan feed amount in the third sub-scanning mode being less than the maximum sub-scan feed amount in the second sub-scanning mode; and a rear-edge printing unit configured to form dots in the rear-edge portion in accordance with the third sub-scanning mode using the second subgroup of dot-forming elements without use of any of the first, third, and fourth sub-groups of dot-forming elements.

4. A dot-recording device as defined in claim 3, wherein the rear-edge printing unit forms dots in the rear-edge portion when the print medium is supported on the platen and the rear edge of the print medium is above the first slot.

5. A dot-recording method using a dot-recording device for recording ink dots on a surface of a print medium, wherein the surface of the print medium being dividable in order from a front edge, into a front-edge portion containing the front edge, a front edge transitional portion, an intermediate portion, a rear-edge transitional portion, and a rear-edge portion containing a rear edge, the dot recording device including a dot-recording head having a group of dot-forming elements for ejecting ink droplets, the method comprising the steps of:

(a) providing a platen configured to support the print medium, the platen including:

a first support member extending in a main scanning direction, a width of the first support member in a sub-scanning direction corresponding to a first sub-scanning range on a surface of the dot-recording head including a preselected first sub-group of dot-forming elements;

a first slot extending in the main scanning direction, a width of the first slot in the sub-scanning direction corresponding to a second sub-scanning range on the surface of the dot-recording head including a preselected second sub-group of dot-forming elements, the second sub-group of dot-forming elements being disposed in the sub-scanning direction downstream from the first sub-group of dot-forming elements;

a second support member extending in the main scanning direction, a width of the second support member in the sub-scanning direction corresponding to a third sub-scanning range on the surface of the dot-recording head including a preselected third sub-group of dot-forming elements, the third sub-group of dot-forming elements being disposed in the sub-scanning direction downstream from the second sub-group of dot-forming elements; and a second slot extending in the main scanning direction, a width of the second slot in the sub-scanning direction corresponding to a fourth sub-scanning range on the surface of the dot-recording head including a preselected fourth sub-scanning range on the surface of the dot-recording head including a preselected fourth sub-group of dot-forming elements, the fourth sub-group being disposed in the sub-scanning direction downstream from the third sub group of dot-forming elements, (b) forming dots in the front-edge portion in accordance with a first sub-scanning mode using the fourth sub-group of dot-forming elements without use of any of the first to third sub-groups of dot-forming elements;

(c) forming dots in the front-edge transitional portion in accordance with the first sub-scanning mode using the first to fourth sub-groups of dot-forming elements;

(d) forming dots in the intermediate portion using the first to fourth sub-groups of dot-forming elements in accordance with a second sub-scanning mode, a maximum sub-scan feed amount in the second sub-scanning mode being greater than a maximum sub-scan feed amount in the first sub-scanning mode.

6. A dot-recording method as defined in claim 5, wherein the step (c) comprises a step of forming dots in the front-edge portion when the print medium is supported on the platen and the front edge of the print medium is above the second slot.

7. A dot-recording method as defined in claim 6, further comprising the steps of:

(f) forming dots in the rear-edge transitional portion using the second to fourth sub-groups of dot-forming elements without use, of the first subgroup of dot-forming elements, the dot forming being performed in accordance with a third sub-scanning mode, a maximum sub-scan feed amount in the third sub-scanning mode being less than the maximum sub-scan feed amount in the second sub-scanning mode;

(g) forming dots in the rear-edge portion in accordance with the third sub-scanning mode using second sub-group o f dot-forming elements without use of any of the first, third, and fourth sub-groups of dot-forming elements.

8. A dot-recording method as defined in claim 7, wherein the step (g) comprises the step of forming dots in the rear-edge portion when the print medium is supported on the platen and the rear edge of the print medium is above the first slot.

9. A computer program product for recording ink dots on a surface of a print medium, wherein the surface of the print medium being dividable in order from a front edge, into a front-edge portion containing the front edge, a front-edge transitional portion, an intermediate portion, a rear-edge transitional portion, and a rear-edge portion containing a rear edge, the computer program product recording with a computer, the computer comprising a platen for supporting the print medium and a dot-recording device for recording ink dots on the surface of the print medium with the aid of a dot-recording head provided with a plurality of dot-forming elements for ejecting ink droplets, wherein the platen comprises:

a first support member extending in the main scanning direction, a width of the first support member in a sub-scanning direction corresponding to a first sub-scanning range on a surface of the dot-recording head including a preselected first sub-group of dot-forming elements;

a first slot extending in the main scanning direction, a width of the first slot in the sub-scanning direction corresponding to a second sub-scanning range on the surface of the dot-recording head including a preselected second sub-group of dot-forming elements, the second sub-group of dot-forming elements being disposed in the sub-scanning direction downstream from the first sub-group of dot-forming elements;

a second support member extending in the main scanning direction, a width of the second support member in the sub-scanning direction corresponding to a third sub-scanning range on the surface of the dot-recording head including a preselected third sub-group of dot-forming elements, the third sub-group of dot-forming elements being disposed in the sub-scanning direction downstream from the second sub-group of dot-forming elements; and a second slot extending in the main scanning direction, a width of the second slot in the sub-scanning direction corresponding to a fourth sub-scanning range on the surface of the dot-recording head including a preselected fourth sub-group of dot-forming elements, the fourth sub-group being disposed in the sub-scanning direction downstream from the third subgroup of dot-forming elements, the computer program product comprising:

a computer readable medium; and a computer program stored on the computer readable medium, wherein the computer program comprises:

a front-edge printing program for causing the computer to form dots in the front edge portion in accordance with a first sub-scanning mode using the fourth sub-group of dot-forming elements without use of any of the first to third sub-groups of dot-forming elements;

a front-edge transitional printing program for causing the computer to form dots in the front-edge transitional portion in accordance with the first sub-scanning mode using the first to fourth sub-groups of dot-forming elements;

an intermediate printing program for causing the computer to form dots in the intermediate portion using the first to fourth sub-groups of dot-forming elements in accordance with a second sub-scanning mode, a maximum sub-scan feed amount in the second sub-scanning mode being greater than a maximum sub-scan feed amount in the first sub-scanning mode.

10. A computer program product as defined in claim 9, wherein the computer program further comprising:

a rear-edge transitional printing program for causing the computer to form dots in the rear-edge transitional portion with the aid of the second to fourth sub-groups of dot-forming elements without use of the first sub-group of dot-forming elements, the dot forming being performed in accordance with a third sub-scanning mode, a maximum sub-scan feed amount in the third sub-scanning mode being less than the maximum sub-scan feed amount in the second sub-scanning mode;

a rear-edge printing program for causing the computer to form dots in the rear-edge portion in accordance with the third sub-scanning mode with the aid of the second sub-group of dot-forming elements without use of any of the first, third, and fourth sub-groups of dot-forming elements.

* * * * *